US009002240B2

(12) United States Patent
Shimizu et al.

(10) Patent No.: US 9,002,240 B2
(45) Date of Patent: Apr. 7, 2015

(54) DEVELOPING DEVICE AND IMAGE FORMING APPARATUS

(71) Applicant: Kyocera Document Solutions Inc., Osaka-shi, Osaka (JP)

(72) Inventors: Tamotsu Shimizu, Osaka (JP); Takahisa Nakaue, Osaka (JP); Teruhiko Nagashima, Osaka (JP); Takashi Morita, Osaka (JP)

(73) Assignee: KYOCERA Document Solutions Inc. (JP)

( * ) Notice: Subject to any disclaimer, the term of this patent is extended or adjusted under 35 U.S.C. 154(b) by 154 days.

(21) Appl. No.: 13/787,347

(22) Filed: Mar. 6, 2013

(65) Prior Publication Data

US 2013/0243492 A1 Sep. 19, 2013

(30) Foreign Application Priority Data

Mar. 13, 2012 (JP) ..... 2012-055318

(51) Int. Cl.
*G03G 15/08* (2006.01)

(52) U.S. Cl.
CPC ..... *G03G 15/0879* (2013.01); *G03G 15/0886* (2013.01)

(58) Field of Classification Search
CPC ..... G03G 15/0879; G03G 15/0886
USPC ..... 399/260, 102, 103, 105, 106
See application file for complete search history.

(56) References Cited

U.S. PATENT DOCUMENTS

| | | | | |
|---|---|---|---|---|
| 5,402,216 | A | 3/1995 | Komaki et al. | |
| 2004/0052553 | A1 | 3/2004 | Isomura et al. | |
| 2005/0025529 | A1 | 2/2005 | Isomura et al. | |
| 2006/0257172 | A1 * | 11/2006 | Seo | 399/258 |
| 2007/0196136 | A1 | 8/2007 | Yamamoto et al. | |

FOREIGN PATENT DOCUMENTS

| | | |
|---|---|---|
| JP | 6-208299 | 7/1994 |
| JP | Hei 6-95505 | 8/1994 |
| JP | 2001027839 | 1/2001 |
| JP | 2004333608 | 11/2004 |
| JP | 2008-46250 | 2/2008 |
| JP | 2010-55035 | 3/2010 |
| JP | 2011242528 | 12/2011 |

OTHER PUBLICATIONS

Machine translation of Furuya, JP 2001-027839.*
Japanese Office Action—Jul. 8, 2014.

* cited by examiner

*Primary Examiner* — David Gray
*Assistant Examiner* — Sevan A Aydin
(74) *Attorney, Agent, or Firm* — Gerald E. Hespos; Michael J. Porco; Matthew T. Hespos

(57) ABSTRACT

The present application discloses a developing device including a housing having a connection surface to which the container connects. The connection surface is provided with a feed port for feeding the developer. The developing device includes a shutter mechanism configured to selectively open and close the feed port. The shutter mechanism includes a shutter piece, which moves between a closing position for closing the feed port and an opening position for opening the feed port, and a squeezing mechanism, which protrudes from the shutter piece situated in the closing position to squeeze the developer into the housing through the feed port.

5 Claims, 39 Drawing Sheets

(SECOND OPENING POSITION)

(FIRST CLOSING POSITION)

(SECOND CLOSING POSITION)

(SECOND OPENING POSITION)

(SECOND OPENING POSITION)

(SECOND CLOSING POSITION)

(CONNECTION PROCESS)

(DISCONNECTION PROCESS)

(FIRST OPENING POSITION)

(FIRST CLOSING POSITION)

DEVELOPING DEVICE AND IMAGE FORMING APPARATUS

The present application claims priority to Japanese Patent Application No. 2012-55318 filed in the Japan Patent Office on Mar. 13, 2012, the contents of which are hereby incorporated by reference.

BACKGROUND

The present disclosure relates to a developing device and an image forming apparatus which forms an image with developer.

An image forming apparatus such as a printer and a copying machine includes a developing apparatus, which develops an electrostatic latent image with developer, and a container, which supplies the developer to the developing device. If the developer stored in the container runs low, a user replaces the container with a new container.

The developing device may be elongated in a substantially orthogonal direction to a conveying direction of sheets. Accordingly, an image may be formed over the entire width of a sheet. A known container is supported by the developing device and inserted along the extending direction of the developing device, and is eventually connected to the developing device. Therefore, the container is stably supported by the developing device when the container is connected to and disconnected from the developing device.

Another known container is connected to the developing device without any support by the developing device. In this case, the container does not have to be inserted along the developing device. Therefore, an arrangement of the container is relatively freely designed. However, the container is likely to be unstably attached to and detached from the developing device.

A developing device includes a housing provided with a feed port for supply of developer. A container includes a housing which is provided with a supply port communicating with the feed port. A flow of the developer supplied from the container to the developing device traverses a boundary between the feed and supply ports. Therefore, if the container is removed from the developing device, a layer surface of the developer in the housing of the developing device may be substantially flush with the feed port.

If the container attached to and detached from the developing device is unstably held as described above, the housing of the container may scrape out the developer from the housing of the developing device near the feed port. Accordingly, the image forming apparatus may be contaminated by the developer.

An object of the present disclosure is to provide a developing device and an image forming apparatus including a structure for appropriately connecting the developing device with a container.

SUMMARY

A developing device according to one aspect of the present disclosure develops an electrostatic latent image with developer supplied from a container. The developing device includes a housing including a connection surface to which the container connects. The connection surface is provided with a feed port for feeding the developer. The developing device includes a shutter mechanism configured to selectively open and close the feed port. The shutter mechanism includes a shutter piece, which moves between a closing position for closing the feed port and an opening position for opening the feed port, and a squeezing mechanism, which protrudes from the shutter piece situated in the closing position to squeeze the developer into the housing through the feed port.

DETAILED DESCRIPTION

An image forming apparatus and a developing device are described with reference to the accompanying drawings. Directional terms such as "upper", "lower", "left" and "right" are merely used for clarifying the description. Therefore, the terms do not by any means limit principles of the image forming apparatus and the developing device.

(Image Forming Apparatus)

Figure 1:
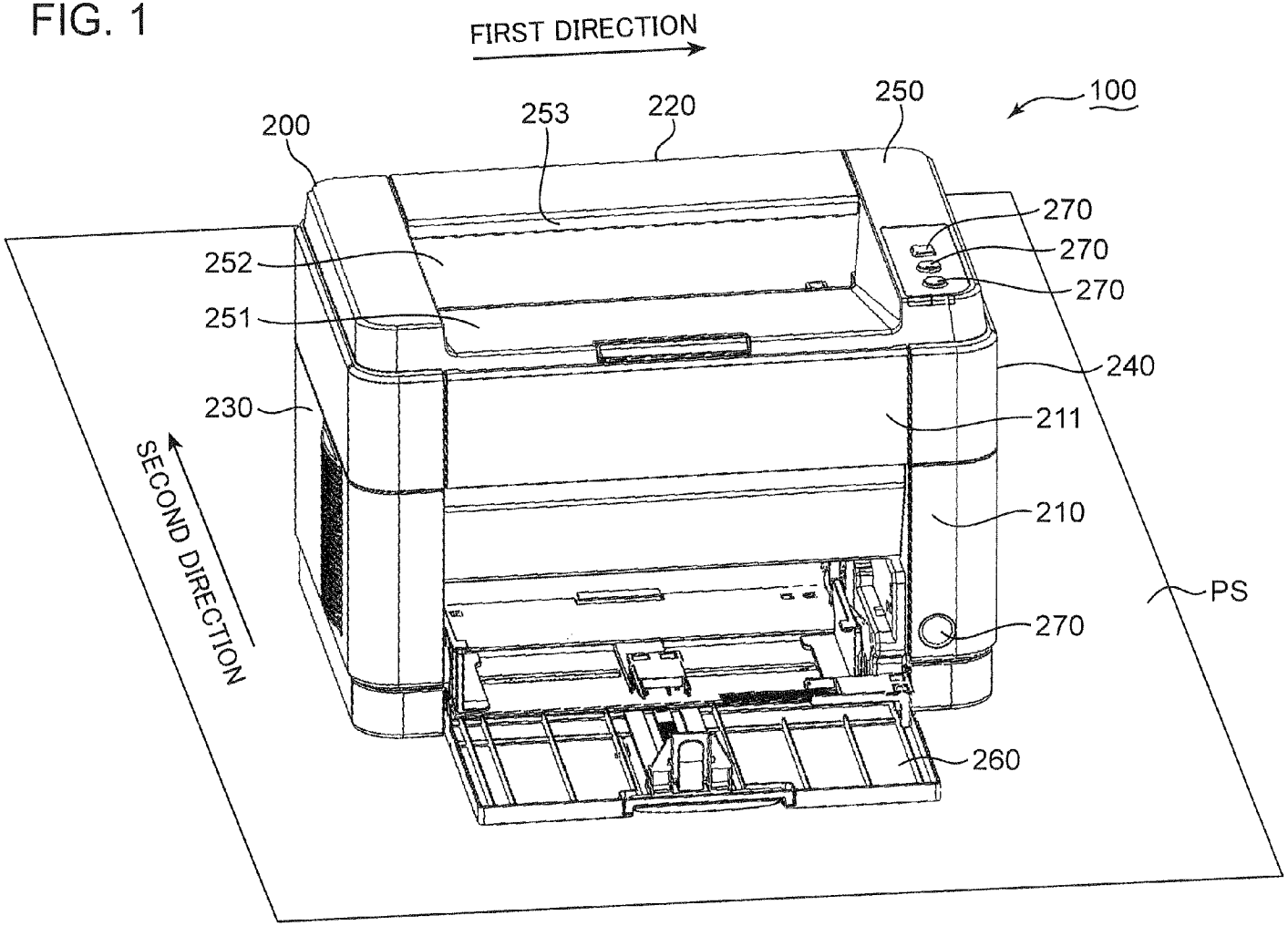
FIG. 1 is a schematic perspective view of a printer exemplified as an image forming apparatus.

FIG. 1 is a schematic perspective view of the printer 100 exemplified as the image forming apparatus. The printer 100 is described with reference to FIG. 1. The image forming apparatus may be a copier or another apparatus configured to form images on sheets.

The printer 100 includes a main housing 200 which defines a room for storing various devices configured to form images on sheets (e.g. a photoconductor drum, a developing device or a container). The main housing 200 includes a front wall 210 perpendicular to a surface PS, onto which the printer 100 is placed; a back wall 220 opposite to the front wall 210; a left wall 230 situated between the front and back walls 210, 220; a right wall 240 opposite to the left wall 230; and a top wall 250 surrounded by the upper edges of the front, back, left and right walls 210, 220, 230, 240. In the following description, the direction from the left wall 230 to the right wall 240 is referred to as "first direction". The direction from the front wall 210 to the back wall 220 is referred to as "second direction". The first direction is orthogonal to the second direction. The term "orthogonal" does not only mean an intersection at an angle of exact "90°". An angle of intersection around "90°" is also included in the term "orthogonal" so long as the principles of the present embodiment are realized. The front and back walls 210, 220 are arranged along the first direction (i.e. the front and back walls 210, 220 are arranged substantially in parallel to the first direction). The left and right walls 230, 240 are arranged along the second direction (i.e. the left and right walls 230, 240 are arranged substantially in parallel to the second direction).

The printer 100 further includes a sheet tray 260 onto which sheets are placed or stored. The sheets placed on the sheet tray 260 are sent into the main housing 200, and then subjected to an image forming process. The rotatable sheet tray 260 is attached to the front wall 210. A user may pull the sheet tray 260 forward to place sheets on the sheet tray 260.

The top wall 250 of the main housing 200 includes a slope wall 251 which defines a recess for accumulating sheets after the image formation process and a discharge wall 252 standing from the slope wall 251. The discharge wall 252 is provided with a discharge outlet 253 from which sheets are discharged. The sheets discharged from the discharge outlet 253 are accumulated on the slope wall 251.

The printer 100 includes multiple operation buttons 270 arranged on the front wall 210 and in an area on the top wall 250 near the front wall 210. Thus, a user in front of the front wall 210 may easily operate the printer 100. As a sheet is discharged from the discharge outlet 253 towards the user standing in front of the front wall 210, the user may easily observe the sheet discharge. In addition, as the sheet tray 260 is also provided on the front wall 210 as described above, the user standing in front of the front wall 210 may observe an amount of the sheets on the sheet tray 260. Therefore, when the user faces the front wall 210, the user may easily operate and observe operations of the printer 100.

The front wall 210 includes a cover panel 211 detachable from the main housing 200. A user may detach the cover panel 211, which forms an upper portion of the front wall 210, in order to access various devices situated in the main housing 200.

Figure 2:
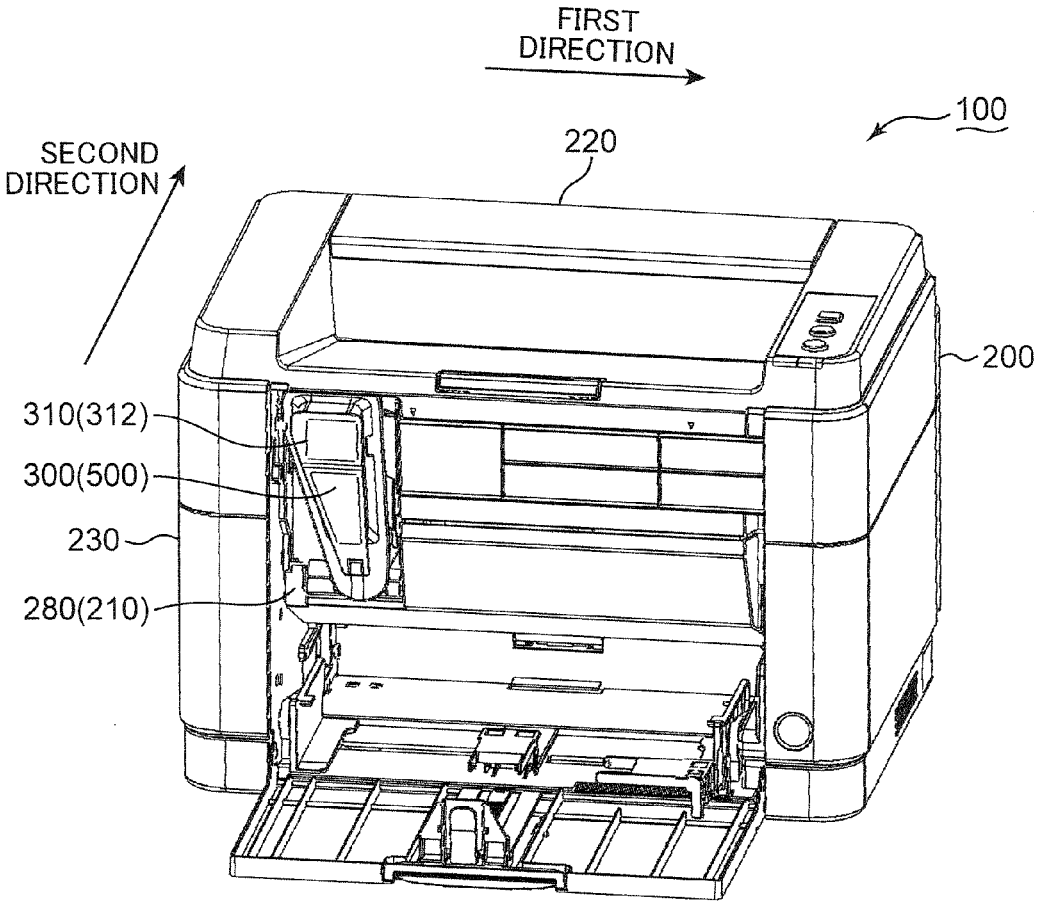
FIG. 2 is a schematic perspective view of the printer from which a cover panel is detached.
Figure 3:
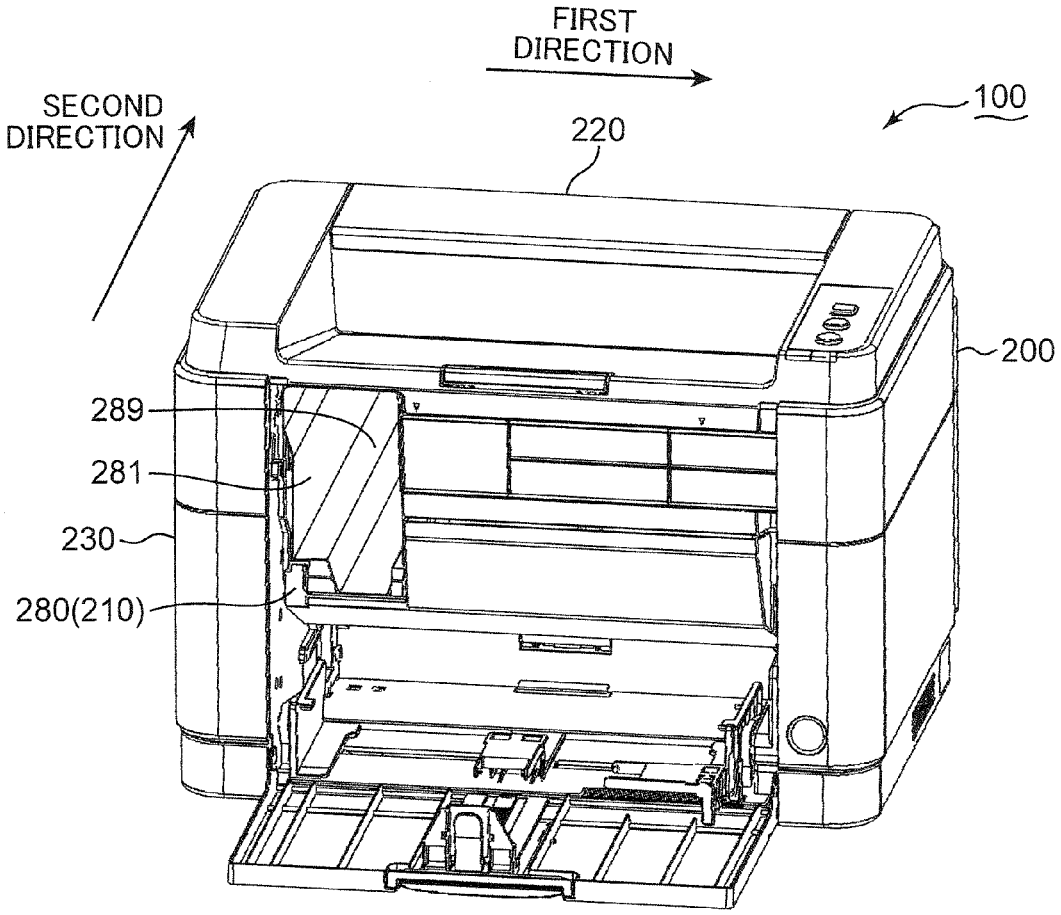
FIG. 3 is a schematic perspective view of the printer from which the cover panel is detached.

FIGS. 2 and 3 are schematic perspective views of the printer 100 from which the cover panel 211 is detached. The printer 100 is further described with reference to FIGS. 1 to 3.

As shown in FIG. 2, the printer 100 further includes a container 300 used as a part of the developing device 500 configured to develop an electrostatic latent image and an inner frame 280 for supporting the container 300 and other devices for forming images. Developer is stored in the container 300. The developer in the container 300 is supplied to a developing device (described below) configured to develop electrostatic latent images. An adjacent portion of the inner frame 280 to the cover plate 211 forms a part of the front wall 210.

A user may detach the cover panel 211 from the main housing 200 to expose the container 300. If the container 300 contains an insufficient amount of the developer, the user may easily pull out the container 300 from the main housing 200.

As shown in FIG. 3, an insertion opening 281 is formed in the inner frame 280 to insert the container 300 into the main hosing 200. A cavity extending in the second direction from the insertion opening 281 formed in the main housing 200 is used as an insertion path 289 for the container 300. The user may push the container 300, which stores a sufficient amount of the developer, into the insertion path 289 defined by the main housing 200 along the left wall 230 via the insertion opening 281. When the container 300 is completely pushed into the insertion path 289, the container 300 is connected to the developing device (described below).

Figure 4:
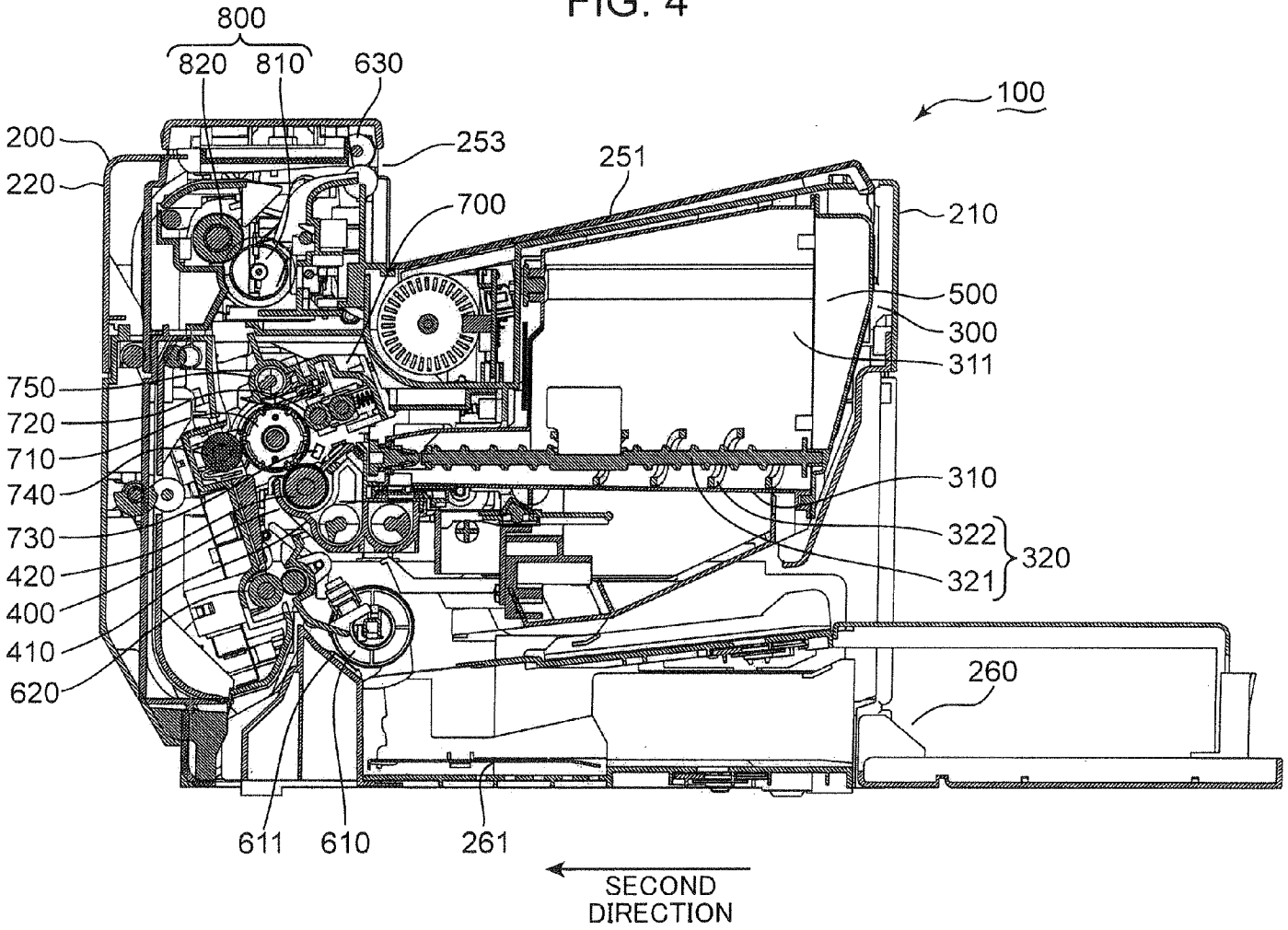
FIG. 4 is a schematic sectional view of the printer shown in FIG. 1.

FIG. 4 is a schematic sectional view of the printer 100. The printer 100 is further described with reference to FIG. 4.

The sheet tray 260 includes a lift plate 261 which lifts the leading edges of sheets. The printer 100 further includes a feed roller 610, which is arranged above the lift plate 261, and a friction plate 611 nearby the feed roller 610. The leading edge of a sheet lifted up by the lift plate 261 hits the feed roller 610. The feed roller 610 rotates so that the sheet is conveyed downstream. Sheets pass between the friction plate 611 and the feed roller 610 one by one downstream. The sheet tray 260 and the feeding structure configured to feed sheets from the sheet tray 260 do not by any means limit the principles of the present embodiment.

The printer 100 further includes a pair of resist rollers 620 situated after the feed roller 610 and an image forming portion 700 which forms images on sheets. The feed roller 610 sends a sheet to the paired resist rollers 620. The paired resist rollers 620 send the sheet to the image forming portion 700 in synchronization with an image forming process in the image forming portion 700. Consequently, an image is formed in position on the sheet.

The image forming portion 700 includes a photoconductor drum 710 having a circumferential surface, on which an electrostatic latent image is formed; a charging device 720, which uniformly charges the circumferential surface of the photoconductor drum 710; and an exposure device 730, which irradiates the charged circumferential surface of the photoconductor drum 710 with laser light. When the photoconductor drum 710 rotates, the circumferential surface of the photoconductor drum 710 charged by the charging device 720 moves to an exposure position at which the circumferential surface is subjected to an exposure process by the exposure device 730. The printer 100 is electrically connected to an external apparatus (e.g. a personal computer (not shown)) which outputs image signals. The exposure device 730 irradiates the circumferential surface of the photoconductor drum 710 with laser light in response to the image signals from the external apparatus. Consequently, a coincident electrostatic latent image to an image defined by the image signals is formed on the circumferential surface of the photoconductor drum 710.

The image forming portion 700 includes the aforementioned developing mechanism 500. The circumferential surface of the photoconductor drum 710 carrying the electrostatic latent image moves to a development position at which the circumferential surface is subjected to a development process by the developing mechanism 500.

In addition to the aforementioned container 300, the developing mechanism 500 includes a developing device 400 which supplies developer to an electrostatic latent image formed on the circumferential surface of the photoconductor drum 710. As a result of developer supply from the developing device 400, the electrostatic latent image is developed (visualized) to form a toner image on the circumferential surface of the photoconductor drum 710. The structure of the developing mechanism 500 is described hereinafter.

The image forming portion 700 further includes a transfer roller 740 which transfers a toner image formed on the circumferential surface of the photoconductor drum 710 to a sheet. The circumferential surface of the photoconductor drum 710 carrying the toner image moves to a transfer position at which the circumferential surface is subjected to a transfer process by the transfer roller 740. The aforementioned paired resist rollers 620 sends a sheet between the photoconductor drum 710 and the transfer roller 740. The transfer roller 740 electrostatically takes off and transfers the toner image from the photoconductor drum 710 onto a sheet surface.

The image forming portion 700 further includes a cleaning device 750 which removes developer from the circumferential surface of the photoconductor drum 710. The circumferential surface of the photoconductor drum 710 after completion of toner image transfer to a sheet moves to a cleaning position at which the circumferential surface is subjected to a cleaning process by the cleaning device 750. The cleaning device 750 removes developer, which is remained on the circumferential surface of the photoconductor drum 710. The circumferential surface of the photoconductor drum 710 then moves to a charging position, at which the circumferential surface is subjected to another charging process by the charging device 720 to start the next image forming process. The aforementioned image forming process, and structures and arrangements of various devices used for the image forming process do not by any means limit the principles of the present embodiment.

The printer 100 further includes a fixing device 800 configured to fix toner images on sheets. The fixing device 800 includes a heating roller 810, which melts toner of the toner image transferred on the sheet, and a pressure roller 820, which presses the toner image onto the heating roller. The photoconductor drum 710 and the transfer roller 740 send a sheet between the heating roller 810 and the pressure roller 820. Toner of the toner image carried with the sheet is melted by the heating roller 810, and then fixed on the sheet. The structure of the fixing device does not by any means limit the principles of the present embodiment.

The printer 100 further includes a pair of discharge rollers 630 which are arranged nearby the discharge outlet 253 formed on the main housing 200. The heating roller 810 and the pressure roller 820 send a sheet to the paired discharge rollers 630. The paired discharge rollers 630 discharge the sheet on the slope wall 251 through the discharge outlet 253.

(Developing Device)

Figure 5:
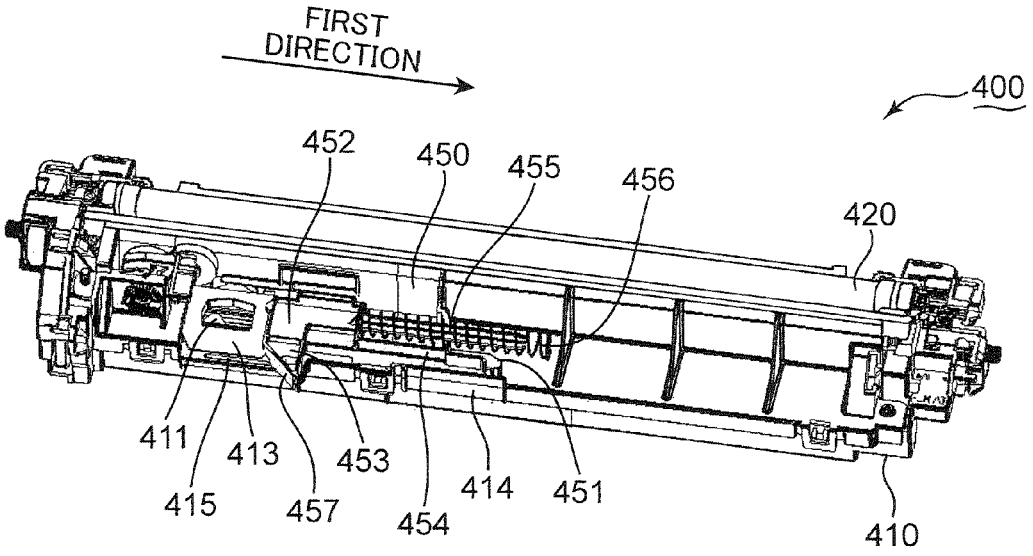
FIG. 5 is a schematic perspective view of a developing device assembled in the printer shown in FIG. 4.

FIG. 5 is a schematic perspective view of the developing device 400. The developing device 400 is described with reference to FIGS. 2, 4 and 5.

The developing device 400 includes a first housing 410 elongated in the first direction (i.e. the width direction of a sheet) and a developing roller 420 supported by the first housing 410. There is a feed port 411 at the left end of the first housing 410.

As shown in FIG. 2, the container 300 is adjacent to the left wall 230. The container 300 inserted along the left wall 230 is connected to the left end of the first housing 410. Developer stored in the container 300 is supplied into the first housing 410 through the feed port 411. In this embodiment, the first housing 410 is exemplified as the housing.

As shown in FIG. 4, the developing roller 420 is adjacent to the photoconductor drum 710. The developing roller 420 carries and supplies developer stored in the first housing 410 to an electrostatic latent image formed on the circumferential surface of the photoconductor drum 710.

Figure 6:
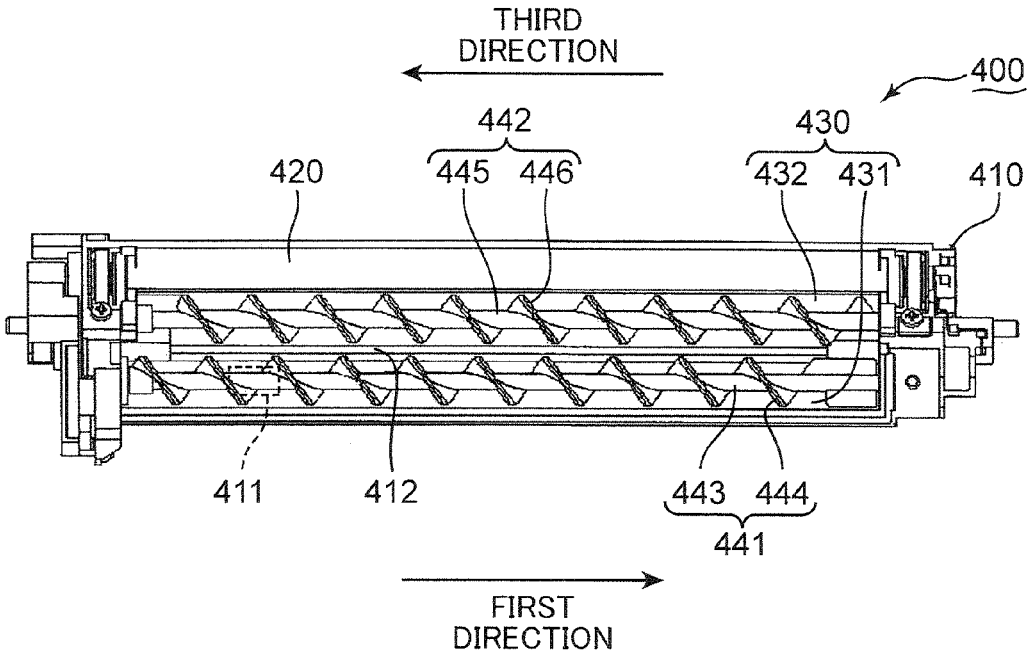
FIG. 6 is a schematic view of an internal structure of the developing device shown in FIG. 5.

FIG. 6 is a schematic view of an internal structure of the developing device 400. The developing device 400 is further described with reference to FIG. 6.

The first housing 410 of the developing device 400 includes a partition wall 412 configured to partition the storage room 430, in which developer is stored, into a first room 431 and a second room 432. In FIG. 6, the aforementioned feed port 411 is shown with a dotted line. The feed port 411 directly communicates with the first room 431. The first room 431 communicates with the second room 432 at the right end of the first housing 410. Developer supplied to the first room 431 through the feed port 411 flows into the second room 432 at the right end of the first housing 410.

The developing device 400 further includes a first conveyance screw 441 situated in the first room 431 and a second conveyance screw 442 situated in the second room 432. The first conveyance screw 441 includes a shaft 443 elongated in the first direction and a screw 444 wound around the shaft 443. The second conveyance screw 442 includes a shaft 445 substantially in parallel to the shaft 443 and a screw 446 wound around the shaft 445.

When the first conveyance screw 441 rotates, developer supplied into the first room 431 is conveyed in the first direction away from the feed port 411. Consequently, the developer reaches the right end of the first housing 410, and then flows into the second room 432.

When the second conveyance screw 442 rotates, the developer flowing in the second room 432 is conveyed in a third direction opposite to the first direction. The developer conveyed by the first and second conveyance screws 441, 442 contains toner particles and carrier particles. The first and second conveyance screws 441, 442 stir these particles during the conveyance. Accordingly, the toner particles are charged and electrostatically adhered to the developing roller 420 during the conveyance by the second conveyance screw 442. Therefore, the developing roller 420 uniformly carries the toner particles.

(Developing Mechanism)

Figure 7:
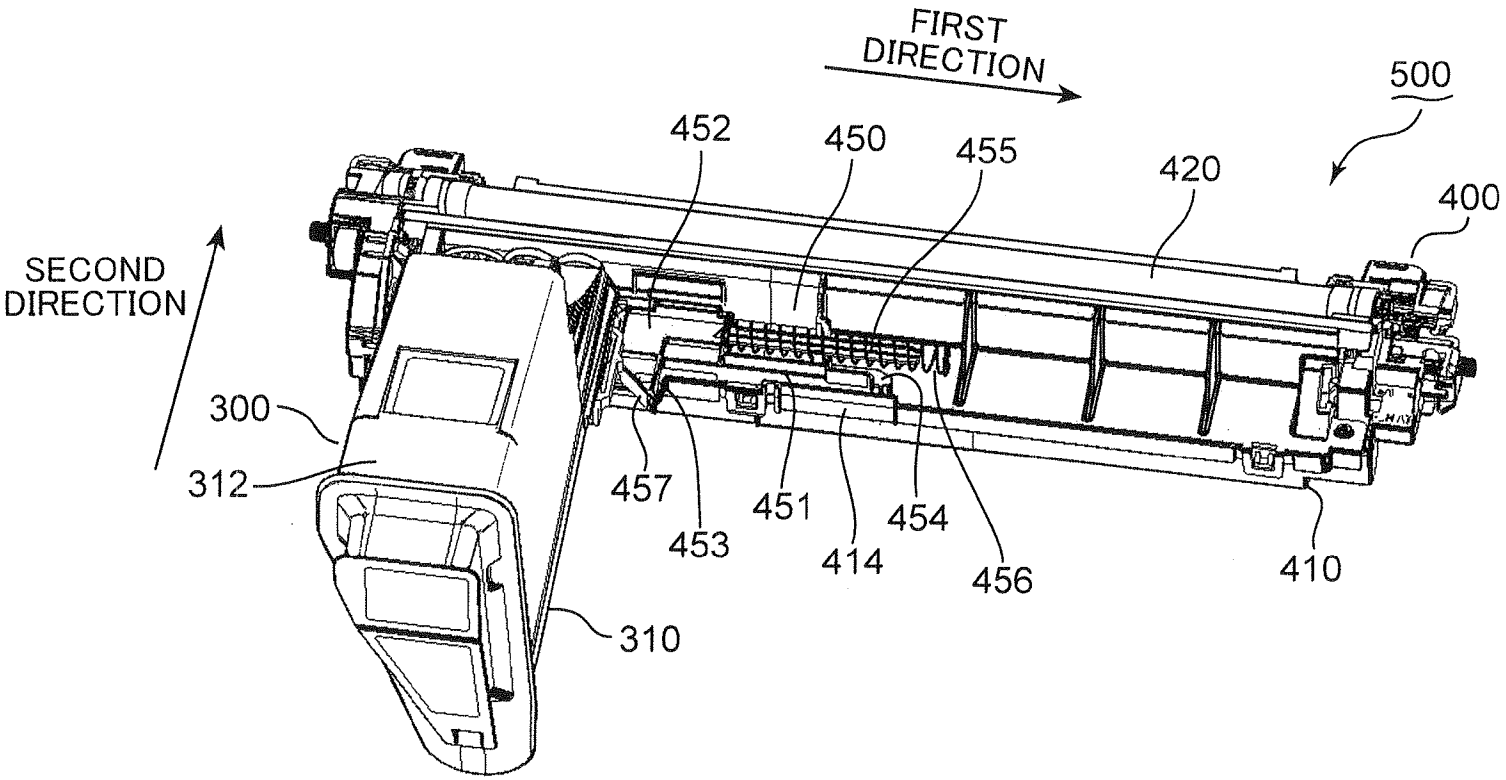
FIG. 7 is a schematic perspective view of a developing mechanism including the developing device shown in FIG. 5.

FIG. 7 is a schematic perspective view of the developing mechanism 500. The developing mechanism 500 is described with reference to FIGS. 2, 4, 5 and 7.

The developing mechanism 500 includes the container 300 and the developing device 400, as described above. When a user pushes the container 300 into the main housing 200 along the left wall 230, the container 300 is connected to the left end of the first housing 410 of the developing device 400.

As shown in FIG. 5, the first housing 410 includes a substantially flat slide surface 413 which surrounds the feed port 411 opening upward. The container 300 includes a second housing 310 defining a storage room 311 (c.f. FIG. 4) in which developer is stored. When the user pushes the container 300 into the main housing 200 along the left wall 230, the container 300 slides on the slide surface 413. In this embodiment, the slide surface 413 is exemplified as the connection surface.

As shown in FIG. 4, the container 300 includes a conveyance screw 320 extending in the second direction. The conveyance screw 320 includes a shaft 321 extending in the second direction and a screw 322 wound around the shaft 321. When the conveyance screw 320 rotates, the developer stored in the second housing 310 is discharged towards the developing device 400.

As shown in FIG. 4, the developing device 400 is arranged near the back wall 220 of the main housing 200 whereas the container 300 is arranged near the front wall 210 rather than the back wall 220. As the conveyance screw 320 discharges developer in the second direction, the developer is appropriately fed from the container 300 to the developing device 400 under an intersectional structure between the container 300 and the developing device 400.

Figure 8:
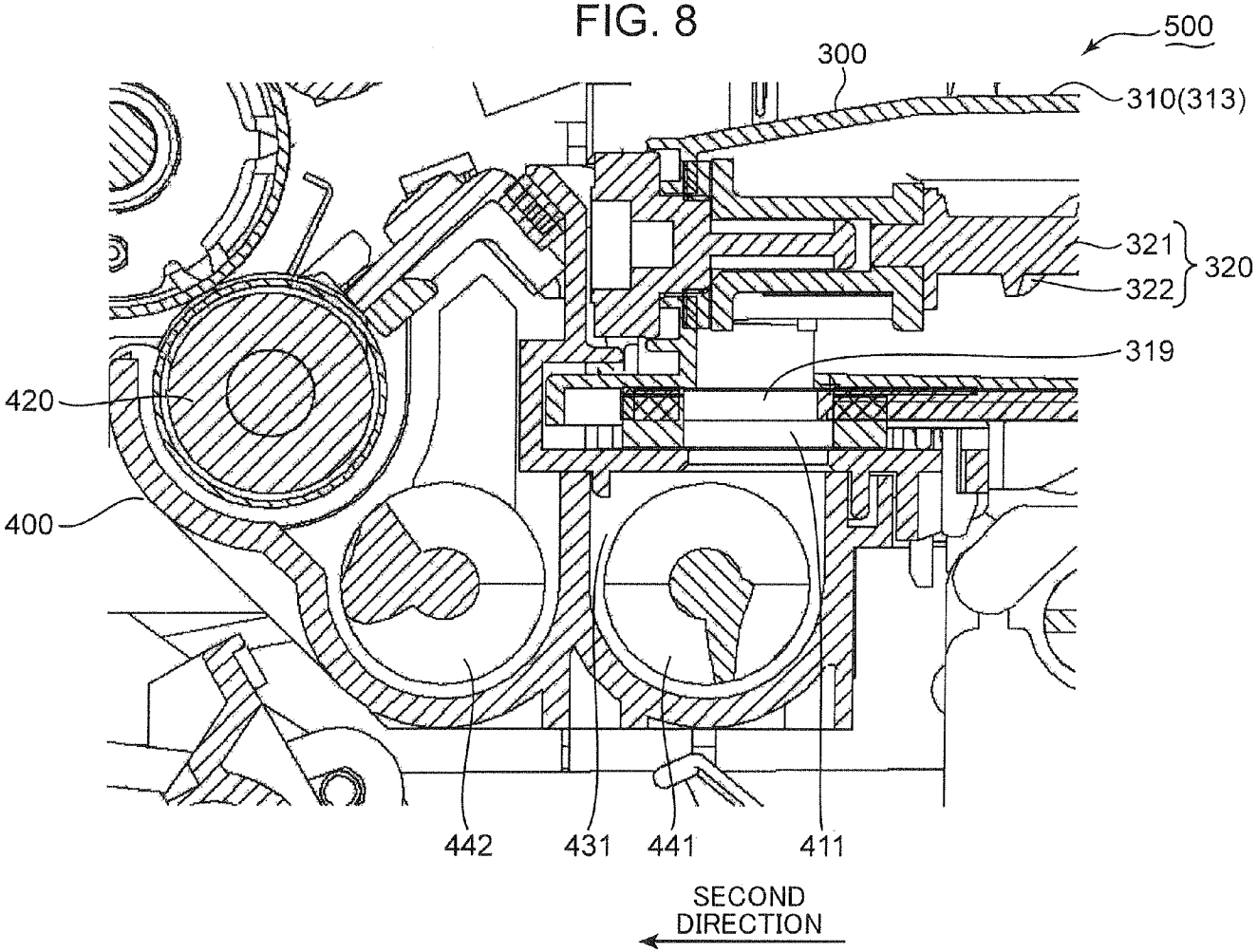
FIG. 8 is a schematic sectional view around a connecting portion between a container and the developing device shown in FIG. 5.

FIG. 8 is a schematic sectional view around a connecting portion between the container 300 and the developing device 400. The developing mechanism 500 is further described with reference to FIGS. 3 and 8.

The lower surface of the second housing 310 is provided with a supply port 319 from which developer is supplied to the developing device 400. When a user pushes the container 300 through the insertion opening 281 towards the back wall 220, the container 300 is connected to the developing device 400. In this case, the supply port 319 opening downward communicates with the feed port 411 opening upward. Consequently, developer conveyed by the conveyance screw 320 drops into the first room 431 by the action of gravity. The developer is then supplied to the developing roller 420 by the first and second conveyance screws 441, 442.

(First Shutter Mechanism)

Figure 9:
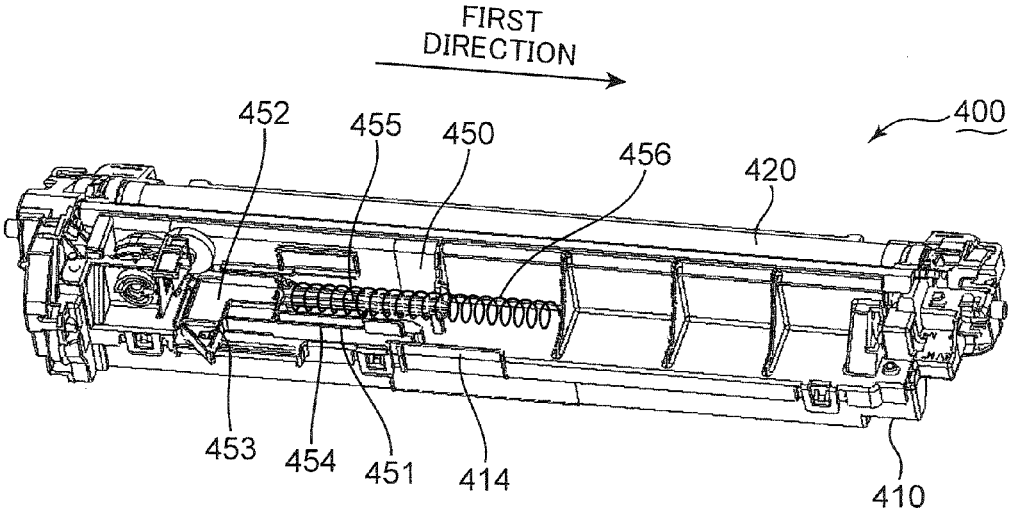
FIG. 9 is a schematic perspective view of the developing device shown in FIG. 5.
Figure 10:
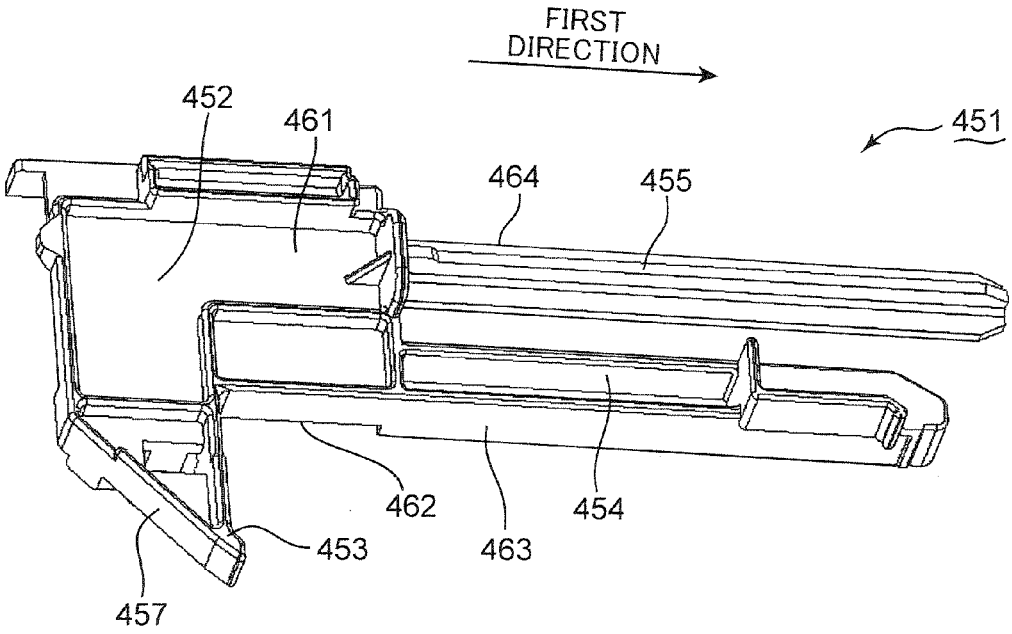
FIG. 10 is a schematic perspective view of a first shutter piece configured to open and close a feed port on the developing device shown in FIG. 9.

FIG. 9 is a schematic perspective view of the developing device 400. FIG. 10 is a schematic perspective view of a first shutter piece 451 which opens and closes the feed port 411. The opening and closing operations for the feed port 411 are described with reference to FIGS. 5, 7, 9 and 10.

The developing device 400 includes a first shutter mechanism 450 which selectively opens and closes the feed port 411. The first shutter mechanism 450 includes the first shutter piece 451. The first shutter piece 451 is displaced between a first closing position for closing the feed port 411 and a first opening position for opening the feed port 411. The first shutter piece 451 shown in FIGS. 5 and 7 is in the first opening position. The first shutter piece 451 shown in FIG. 9 is in the first closing position. In this embodiment, the first shutter mechanism 450 is exemplified as the shutter mechanism. The first shutter piece 451 is exemplified as the shutter piece. The first closing position of the first shutter piece 451 is exemplified as the closing position. The first opening position of the first shutter piece 451 is exemplified as the opening position.

The first shutter piece 451 includes a substantially rectangular sliding plate 452, which slides on the slide surface 413 during the displacement between the first opening and closing positions; a substantially right triangular protruding plate 453, which protrudes towards the container 300 from the sliding plate 452 of the first shutter piece 451 in the first closing position; a guide nail 454, which extends from the sliding plate 452 in the first direction; and a shaft 455, which extends in the first direction between the guide nail 454 and the developing roller 420.

The first housing 410 includes a substantially rectangular guide plate 414 protruding upward. The tip of the guide nail 454 abuts the guide plate 414 during displacement of the first shutter piece 451 between the first opening and closing positions. Therefore, the first shutter piece 451 may be stably displaced between the first opening and closing positions.

The first shutter mechanism 450 further includes a coil spring 456 wound around the shaft 455. The coil spring 456 biases the first shutter piece 451 towards the first closing position.

(Container)

Figure 11:
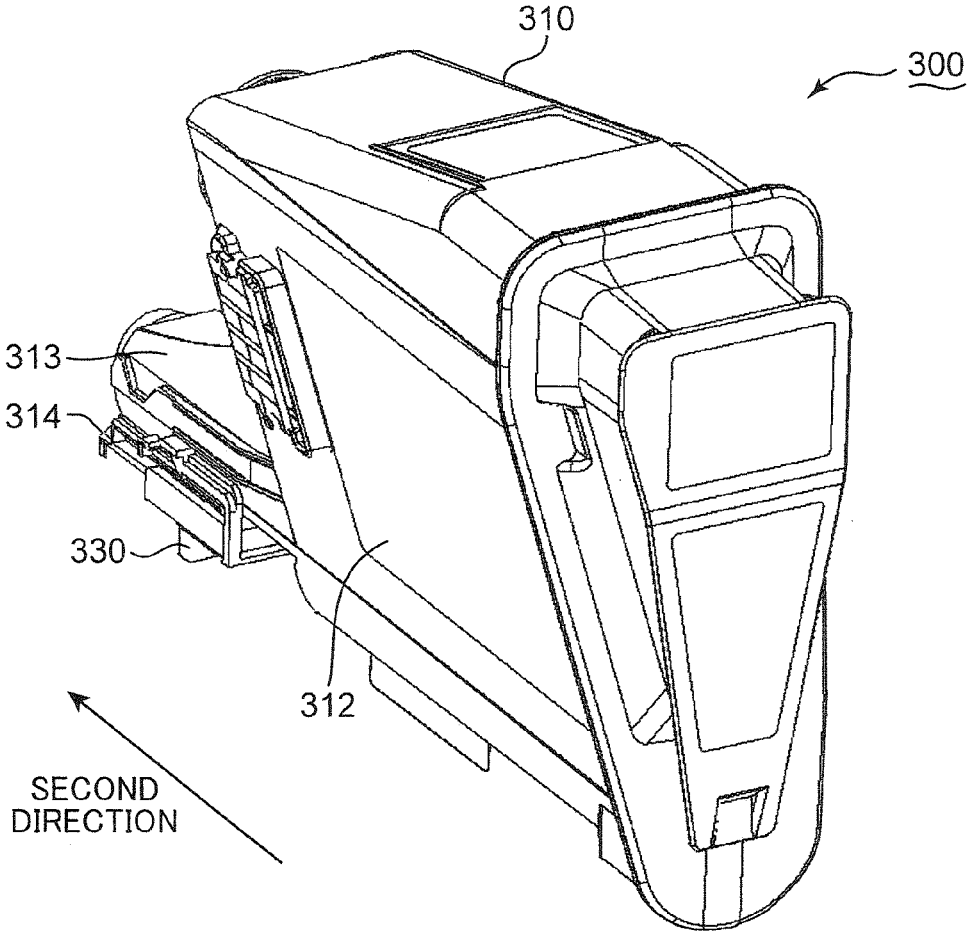
FIG. 11 is a schematic perspective view of the container of the developing mechanism shown in FIG. 7.
Figure 12:
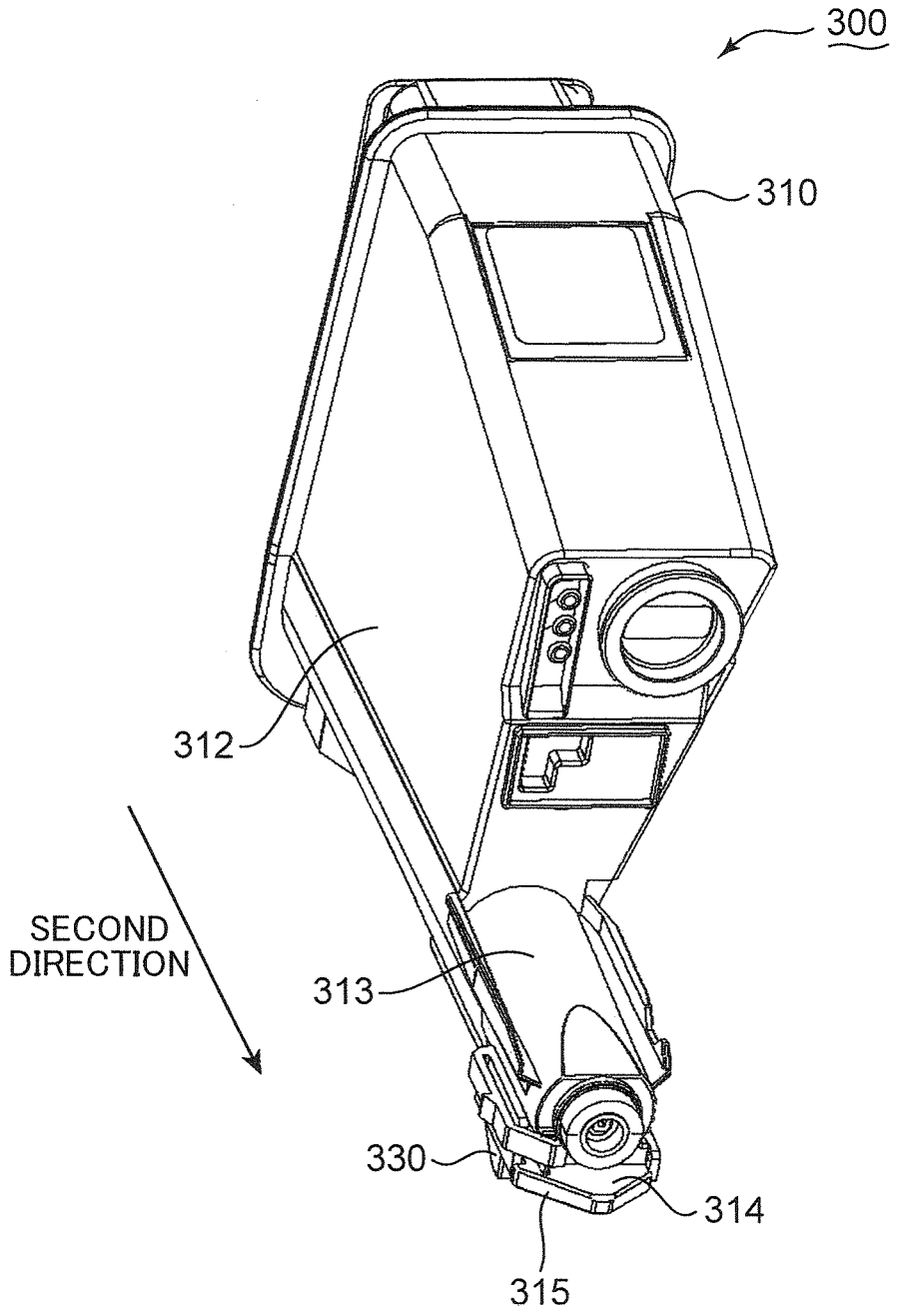
FIG. 12 is a schematic perspective view of the container of the developing mechanism shown in FIG. 7.

FIGS. 11 and 12 are schematic perspective views of the container 300. The container 300 is described with reference to FIGS. 1, 2, 7, 8, 10 to 12.

The second housing 310 of the container 300 includes a main storage portion 312 having a large capacity and a protruding cylinder 313 which protrudes from a lower portion of the main storage portion 312 in the second direction. A user may detach the cover panel 211 to expose the main storage portion 312 (c.f. FIGS. 1 and 2). Therefore, the user may easily attach and detach the container 300 to and from the developing device 400.

A large part of developer is stored in the main storage portion 312. As shown in FIG. 8, the conveyance screw 320 is inserted into the protruding cylinder 313. Thus, the developer is conveyed from the main storage portion 312 to the protruding cylinder 313 as rotation of the conveyance screw 320 and the action of gravity. The developer conveyed by the conveyance screw 320 in the second direction is then discharged through the supply port 319 and supplied to the developing device 400 through the feed port 411.

As shown in FIG. 12, the container 300 further includes a second shutter mechanism 330 which selectively opens and closes the supply port 319 provided at the lower surface of the protruding cylinder 313. The second shutter mechanism 330 is provided at the tip of the protruding cylinder 313.

As shown in FIG. 12, the second housing 310 includes a substantially triangular protruding tongue 314 which protrudes in the second direction. When a user inserts the container 300 in the main housing 200, the protruding tongue 314 hits the developing device 400 at first.

As shown in FIG. 10, the protruding plate 453 of the first shutter piece 451 includes a sloped first contact edge 457. The protruding tongue 314 includes a sloped second contact edge 315. When a user inserts the container 300 in the main housing 200 to connect the container 300 with the developing device 400, the second contact edge 315 hits the first contact edge 457, and then the first and second contact edges 457, 315 slide on each other. Consequently, the first shutter piece 451 is displaced to the first opening position (c.f. FIG. 7). By the displacement of the first shutter piece 451 to the first opening position, the coil spring 456 is compressed.

(Second Shutter Mechanism)

Figure 13A:
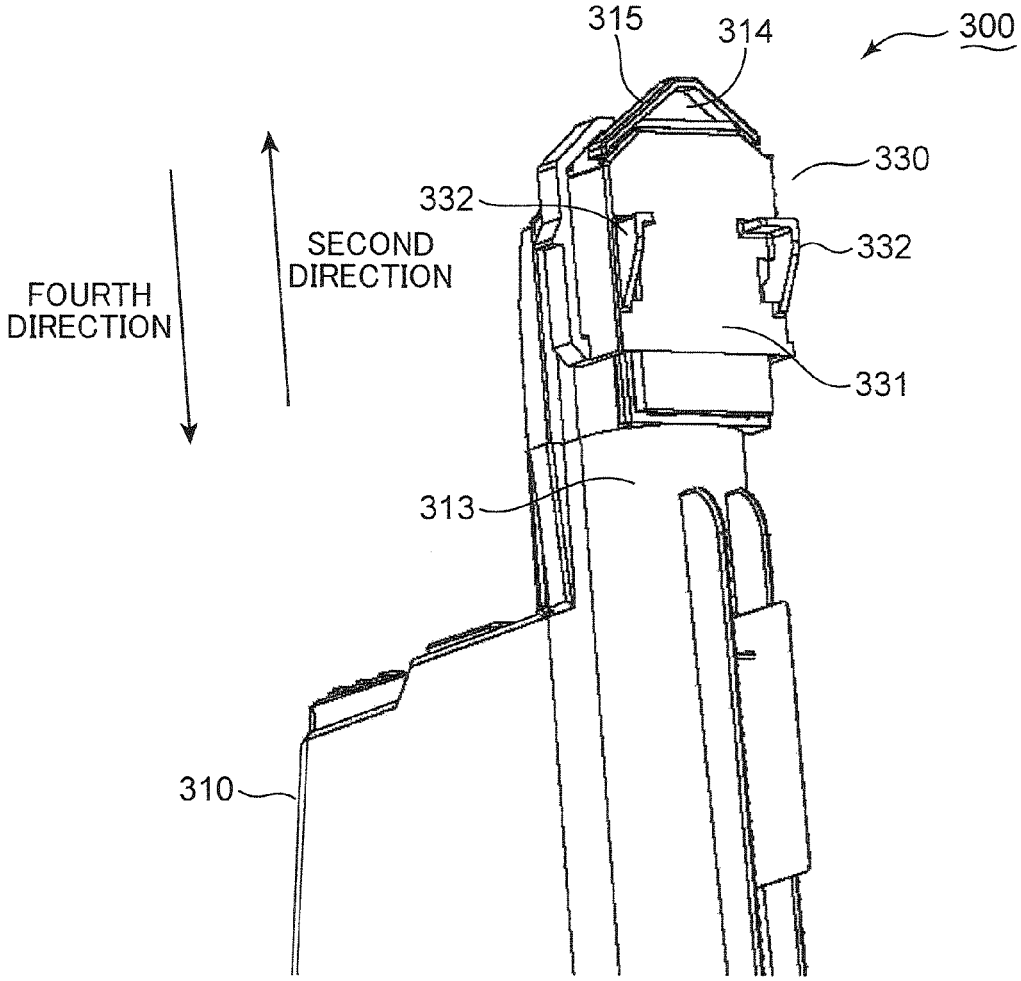
FIG. 13A is a schematic bottom perspective view of the container shown in FIG. 12.
Figure 13B:
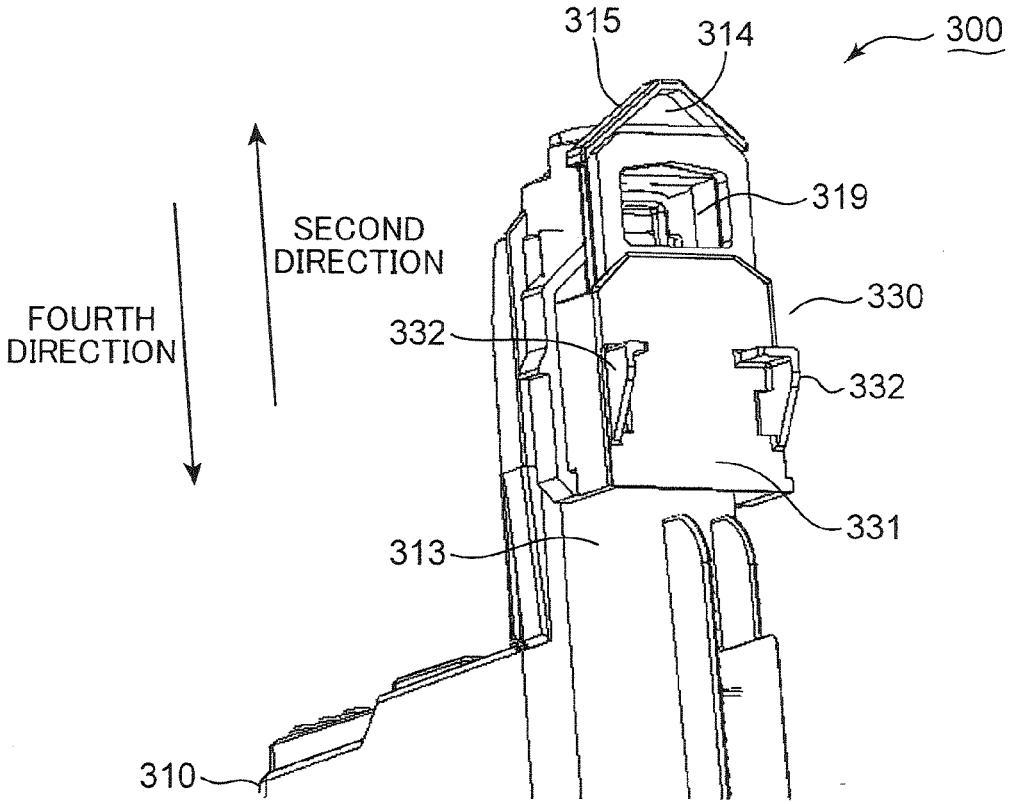
FIG. 13B is a schematic bottom perspective view of the container shown in FIG. 12.

FIGS. 13A and 13B are schematic bottom perspective views of the container 300. The second shutter mechanism 330 is described with reference to FIGS. 13A and 13B.

The second shutter mechanism 330 includes a slidable second shutter piece 331, which is attached to the protruding cylinder 313 of the second housing 310, and a pair of first protrusions 332, which protrude from the lower surface of the second shutter piece 331. The second shutter piece 331 is displaced along the protruding cylinder 313, which protrudes in the second direction, between a second closing position for closing the supply port 319 and a second opening position for opening the supply port 319. The second shutter piece 331 in FIG. 13A is in the second closing position. The second shutter piece 331 shown in FIG. 13B is in the second opening position.

Figure 14:
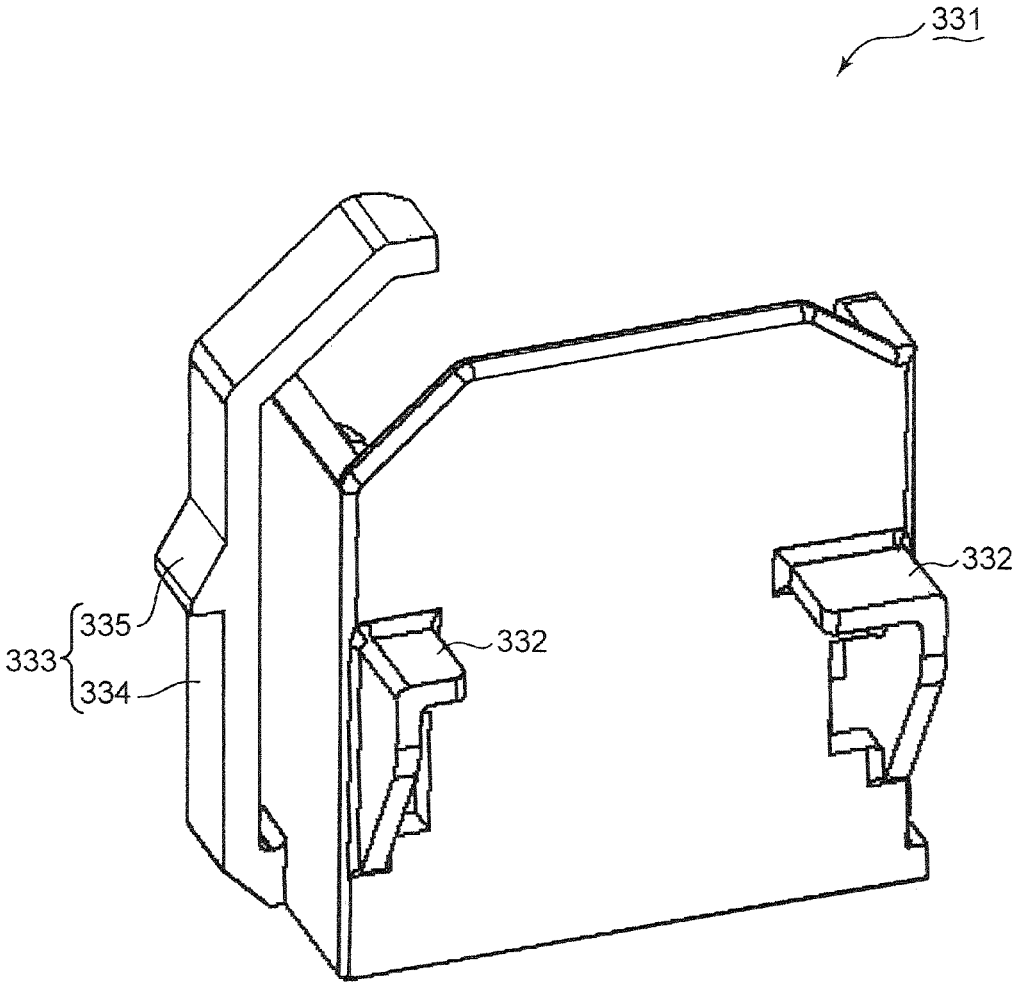
FIG. 14 is a schematic perspective view of a second shutter piece of the container shown in FIG. 12.

FIG. 14 is a schematic perspective view of the second shutter piece 331. The second shutter mechanism 330 is further described with reference to FIGS. 5 and 13A to 14.

As shown in FIG. 5, the slide surface 413 includes a facing edge 415, which faces the first protrusion 332. Before a user connects the container 300 with the developing device 400, the second shutter piece 331 is arranged at the second closing position. When the user moves the container 300 in the second direction, the first protrusion 332 hits the facing edge 415. When the user further pushes the container 300 in the second direction, the second shutter piece 331 is displaced to the second opening position. Consequently, the supply port 319 communicates with the feed port 411.

As described above, when the user connects the container 300 with the developing device 400, the second contact edge 315 of the protruding tongue 314 hits the first contact edge 457 of the first shutter piece 451 at first. Consequently, the first shutter piece 451 is displaced to the first opening position. During the displacement of the first shutter piece 451 from the first closing position to the first opening position, the second shutter piece 331 slides on the slide surface 413. As described above, the first protrusion 332 protruding downward from the second shutter piece 331 then hits the facing edge 415, and thereafter the second shutter piece 331 is displaced to the second opening position. Therefore, the feed port 411 is opened earlier than the supply port 319. Accordingly, there is little leakage of developer in the container 300 outside the developing device 400.

(Connection Process)

Figure 15A:
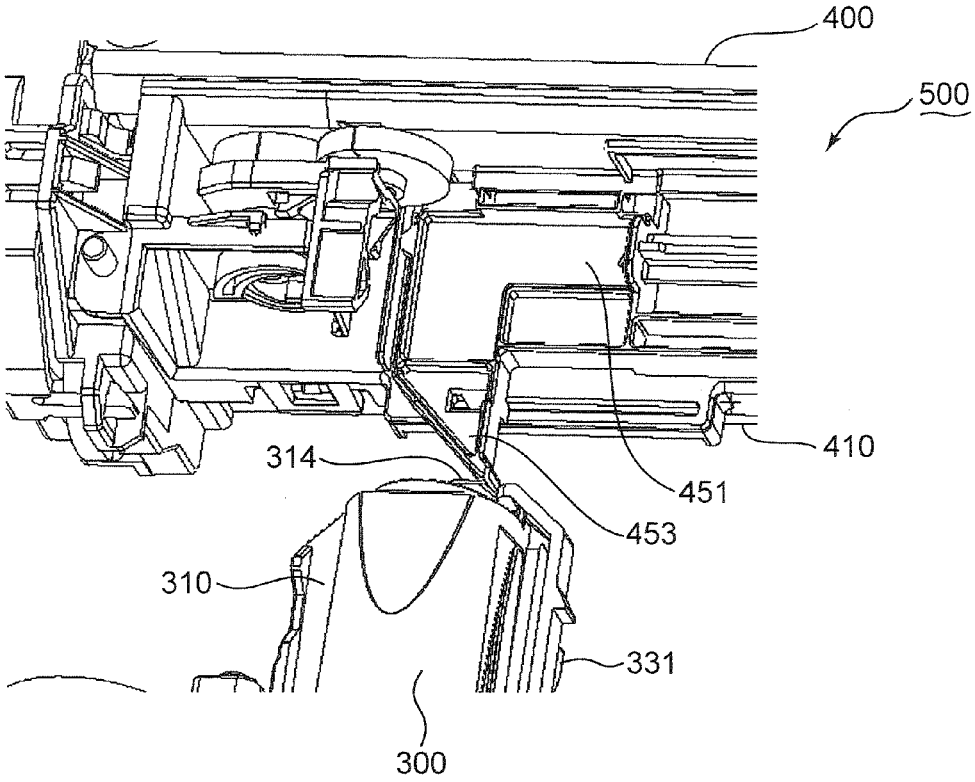
FIG. 15A is a perspective view schematically showing a connection process between the container and the developing device shown in FIG. 5.
Figure 15B:
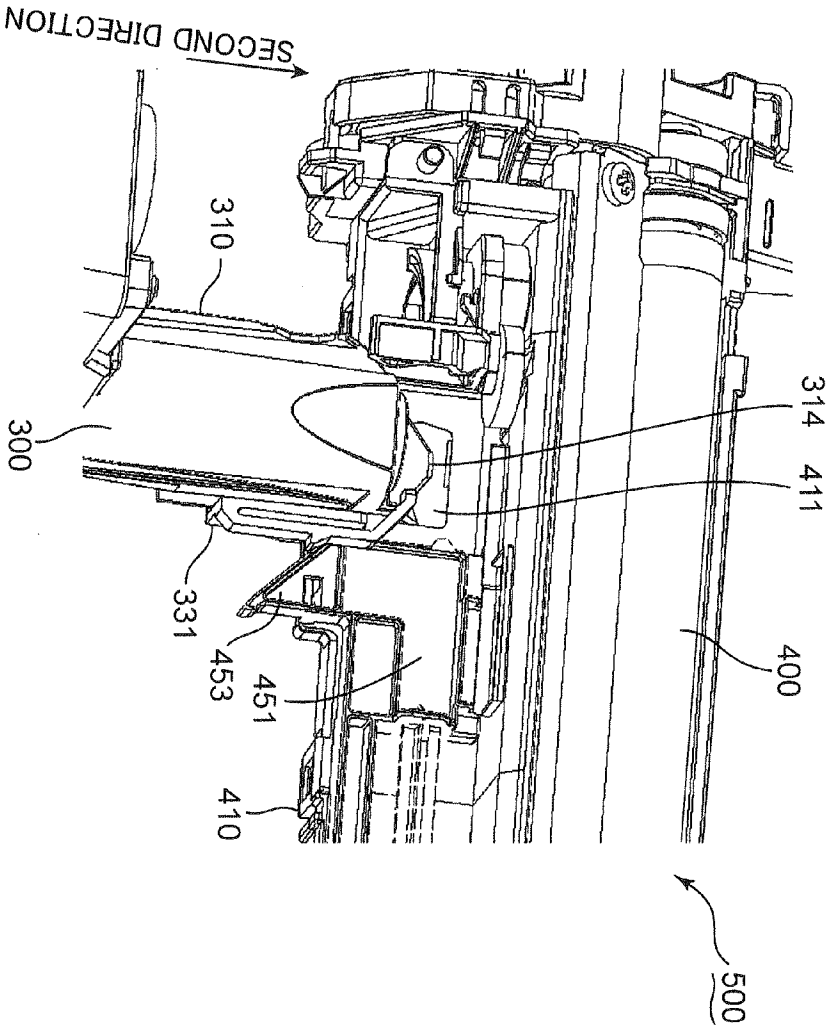
FIG. 15B is a perspective view schematically showing the connection process between the container and the developing device shown in FIG. 5.
Figure 15C:
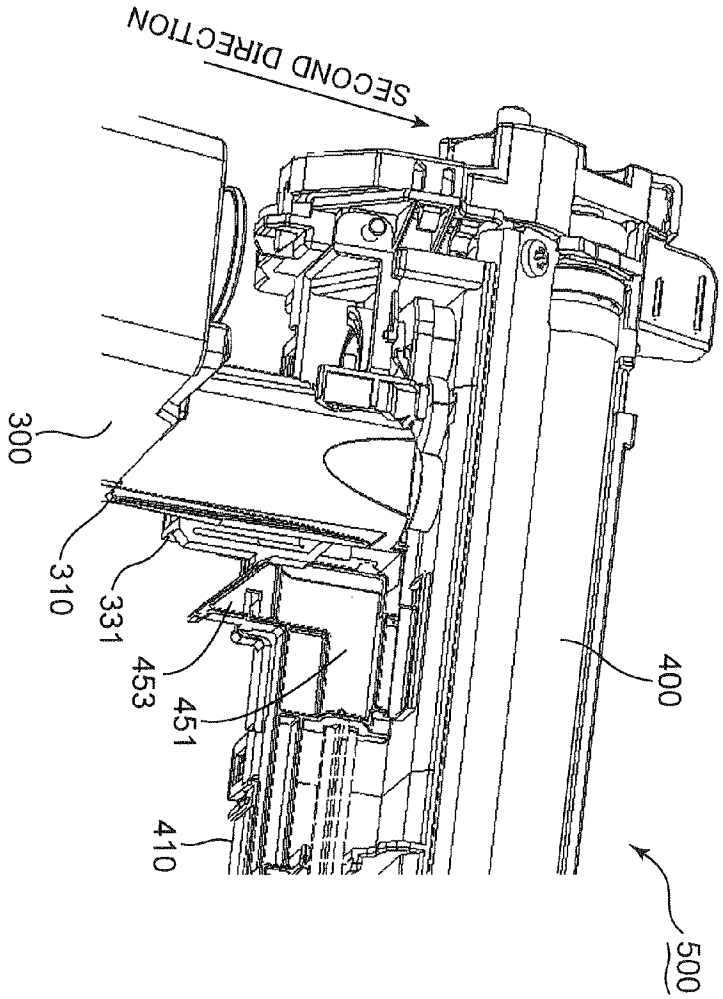
FIG. 15C is a perspective view schematically showing connection between the container and the developing device shown in FIG. 5.

FIGS. 15A to 15C are perspective views schematically showing a connection process of the container 300 with the developing device 400. The connection process of the developing device 400 with the container 300 is described with reference to FIGS. 5, 14 to 15C.

In the process shown in FIG. 15A, the first shutter piece 451 is in the first closing position. The second shutter piece 331 is in the second closing position. The tip of the protruding tongue 314 of the second housing 310 is in contact with the tip of the protruding plate 453 of the first shutter piece 451.

In the process shown in FIG. 15B, the container 300 is pushed further in the second direction from the position shown in FIG. 15A. Consequently, the first shutter piece 451 is displaced to the first opening position. Accordingly, the feed port 411 is opened. The second shutter piece 331 stays at the second closing position in the process shown in FIG. 15B.

In the process shown in FIG. 15C, the container 300 is pushed further in the second direction from the position shown in FIG. 15B. Consequently, the first protrusion 332 protruding from the second shutter piece 331 hits the facing edge 415 of the first housing 410 so that the second shutter piece 331 is displaced to the second opening position.

Figure 16A:
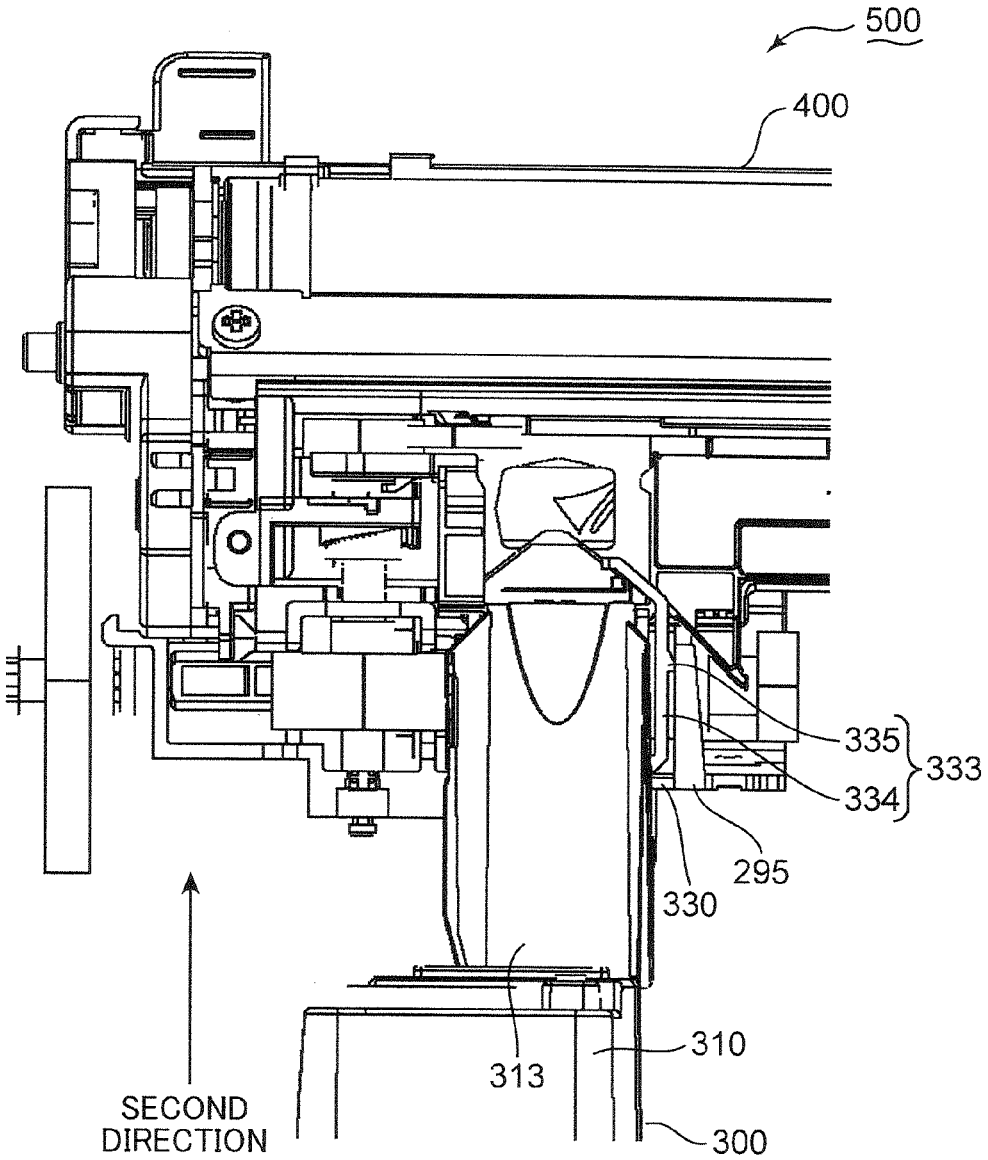
FIG. 16A is a schematic plan view corresponding to FIG. 15B.
Figure 16B:
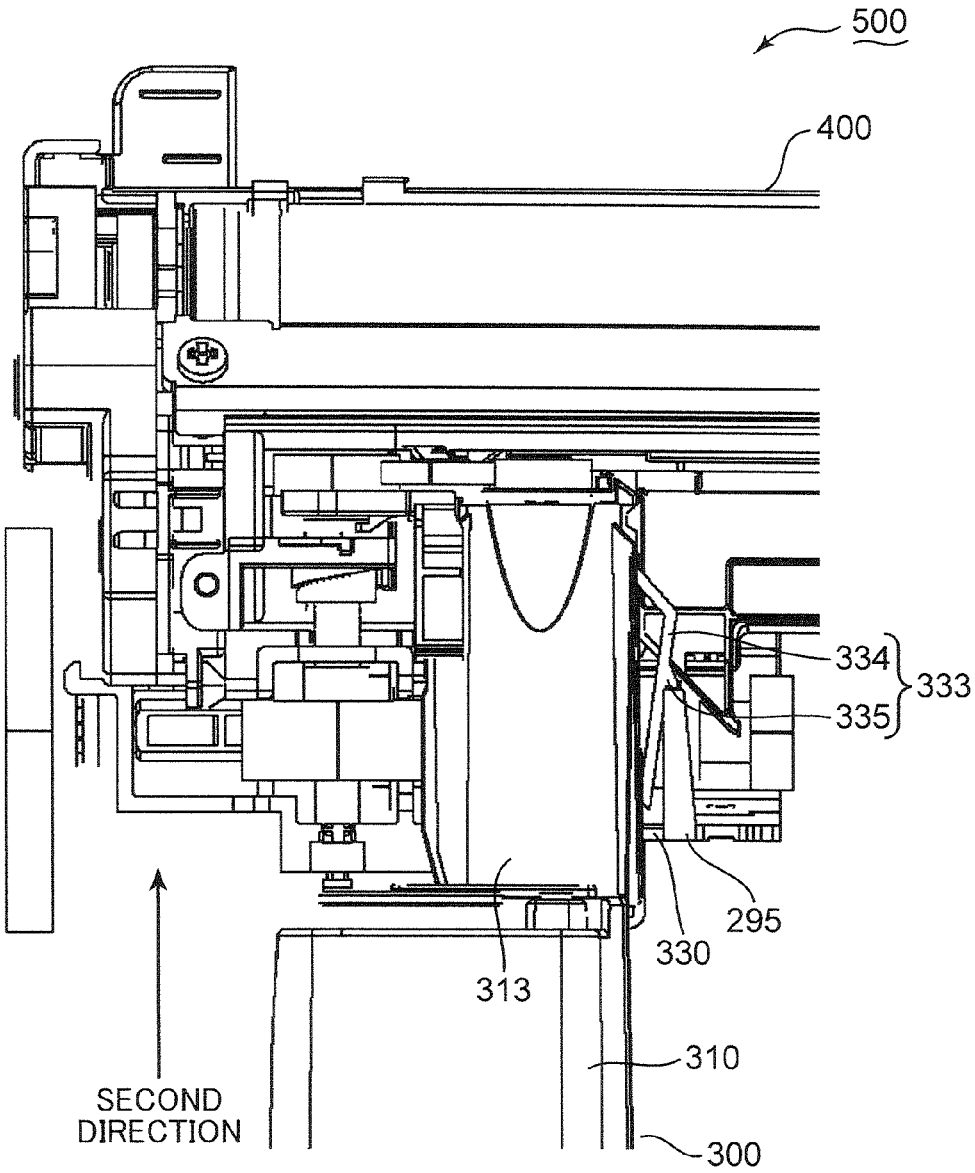
FIG. 16B is a schematic plan view corresponding to FIG. 15C.

FIG. 16A is a schematic plan view corresponding to FIG. 15B. FIG. 16B is a schematic plan view corresponding to FIG. 15C. The connection process is further described with reference to FIGS. 3, 14, 16A and 16B.

The second shutter mechanism 330 further includes a second protrusion 333 protruding rightward from the second shutter piece 331. The second protrusion 333 includes an arm 334 in a substantially J-shape and a projection 335 projecting rightward from the arm 334. As shown in FIG. 16A, while the second shutter piece 331 is in the second closing position, the tip of the arm 334 is situated in front of the protruding cylinder 313 of the second housing 310 in the second direction. The second shutter piece 331 moves backward with respect to the tip of the protruding cylinder 313 in the second direction when the second shutter piece 331 is displaced to the second opening position. Consequently, as shown in FIG. 16B, the tip of the arm 334 hits the right surface of the protruding cylinder 313, and then is bent rightward as a whole.

The developing mechanism 500 further includes a fixed wall 295 situated on the right of the protruding cylinder 313. The fixed wall 295 may be a part fixed in the insertion path 289, which is defined by the main housing 200. In the present embodiment, the fixed wall 295 is fixed to the main housing 200 in the insertion path 289.

The second protrusion 333 is situated between the fixed wall 295 and the protruding cylinder 313. When the arm 334 is curved to the right (i.e. the container 300 is connected to the developing device 400) by the displacement of the second shutter piece 331 to the second opening position, as shown in FIG. 16B, the projection 335 engages with an edge of the fixed wall 295.

(Disconnection Process)

Figure 17A:
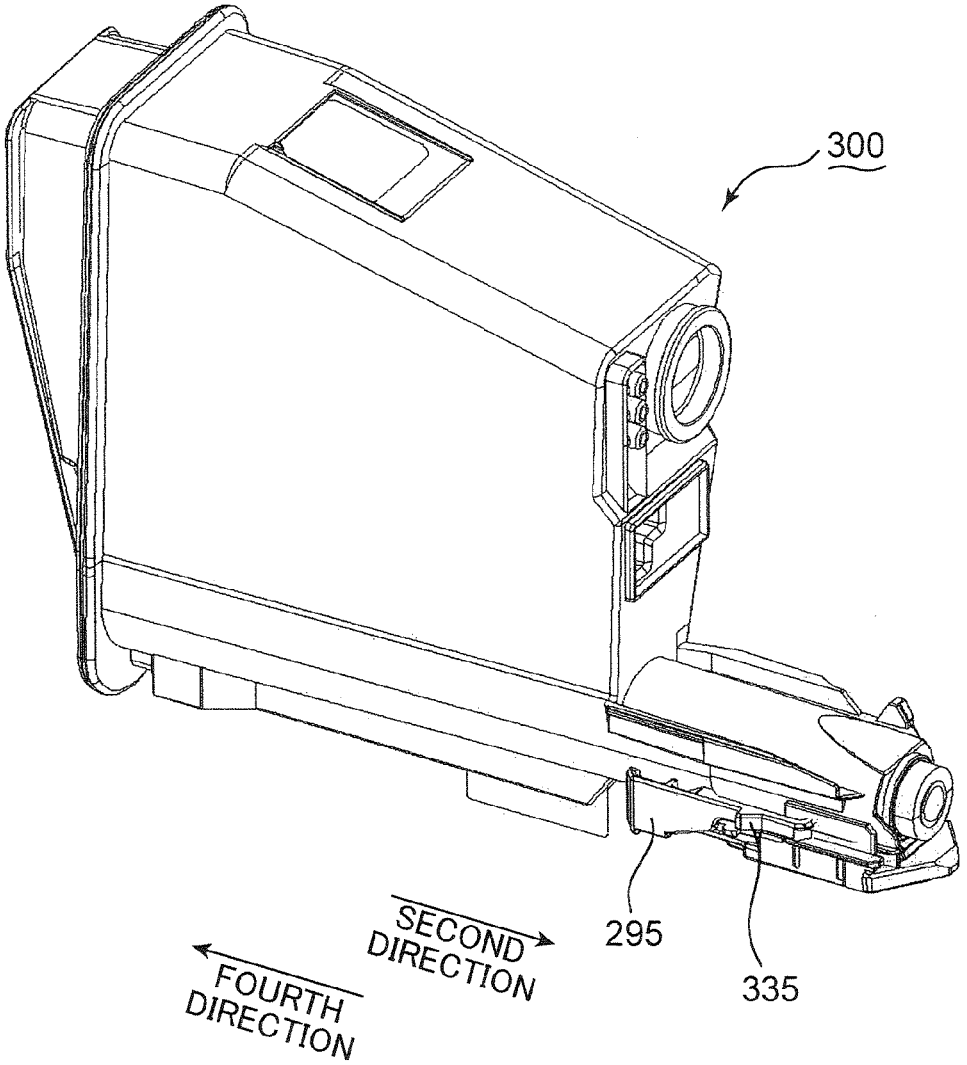
FIG. 17A is a schematic perspective view of the container shown in FIG. 12.
Figure 17B:
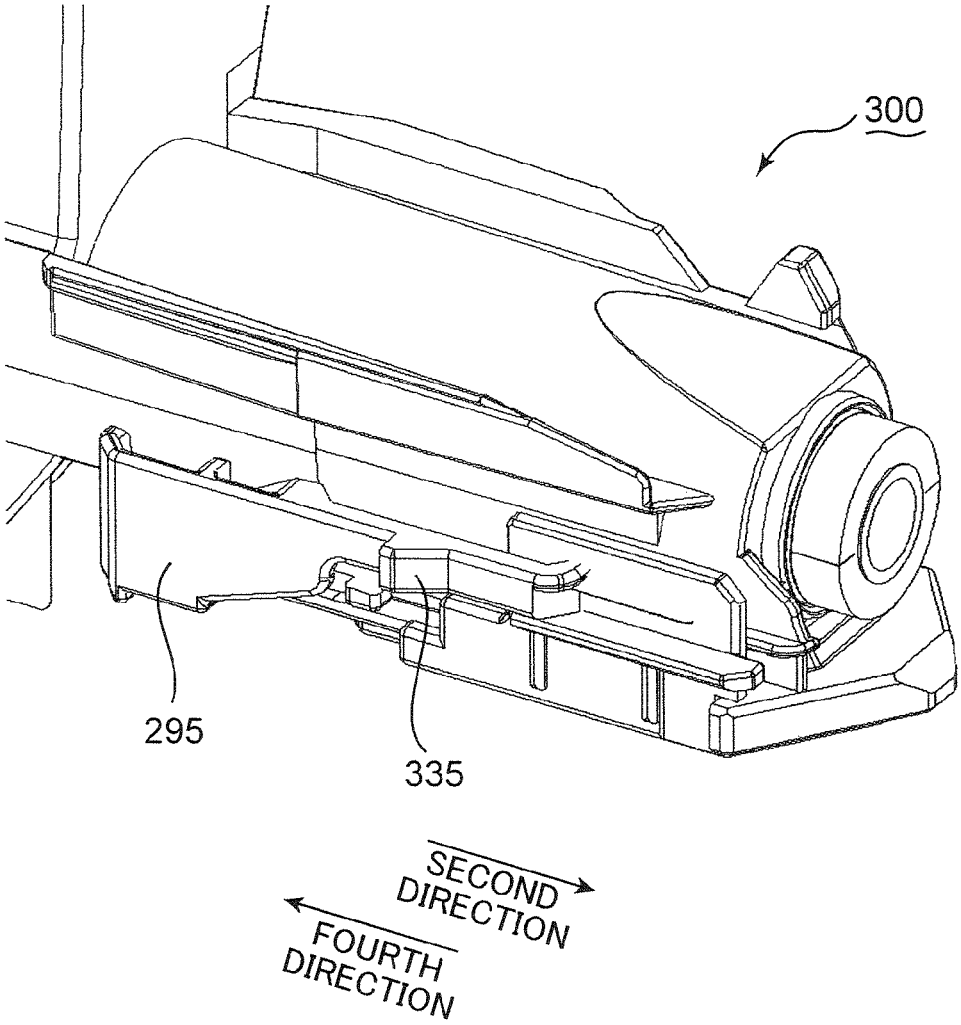
FIG. 17B is a schematic enlarged perspective view of the container shown in FIG. 17A.
Figure 18:
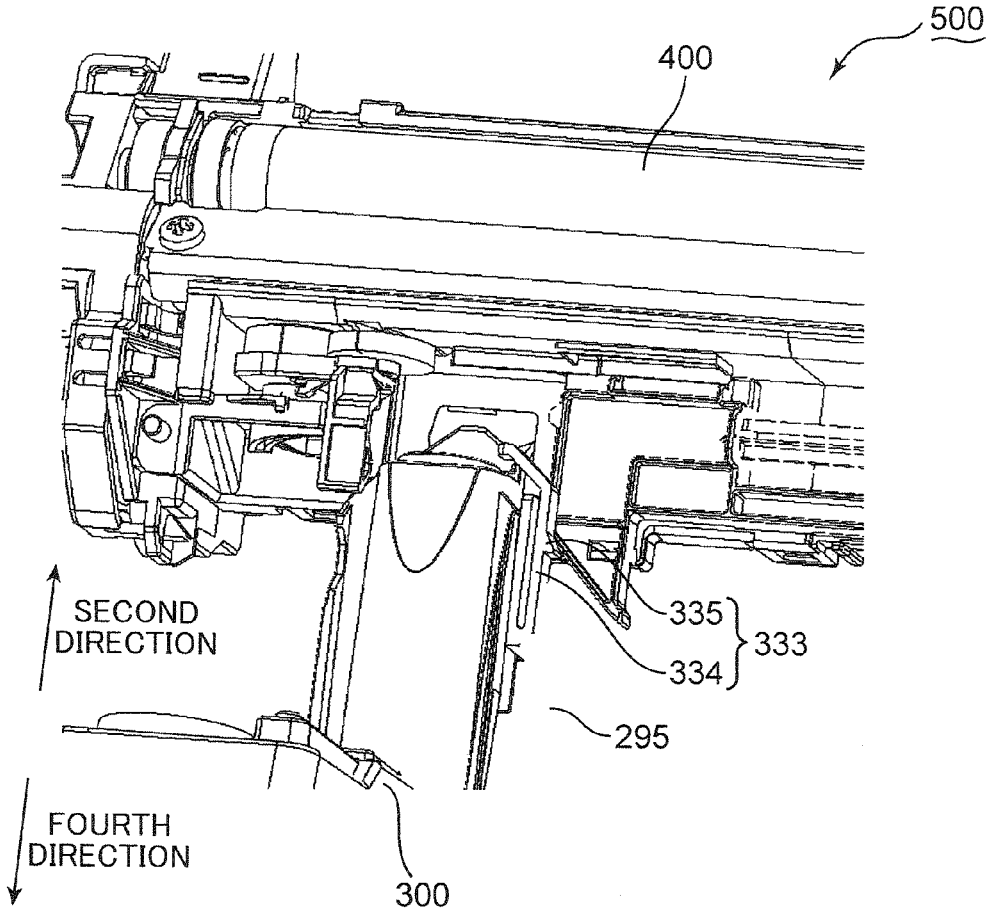
FIG. 18 is a schematic perspective view of a developing mechanism showing a disconnection process for disconnecting the container depicted in FIG. 17A from the developing device.

FIG. 17A is a schematic perspective view of the container 300 engaged with the fixed wall 295. FIG. 17B is a schematic enlarged perspective view of the container 300 around the fixed wall 295. FIG. 18 is a schematic perspective view of the developing mechanism 500 showing a disconnection process for disconnecting the container 300 from the developing device 400. The disconnection process is described with reference to FIGS. 17A to 18.

In the disconnection process, a user pulls out the container 300 in a fourth direction opposite to the second direction. The second shutter piece 331 is displaced from the second opening position to the second closing position due to the engagement between the fixed wall 295 and the projection 335. Therefore, the developer is less likely to leak during the disconnection of the container 300 from the developing device 400.

(Lock Mechanism)

Figure 19:
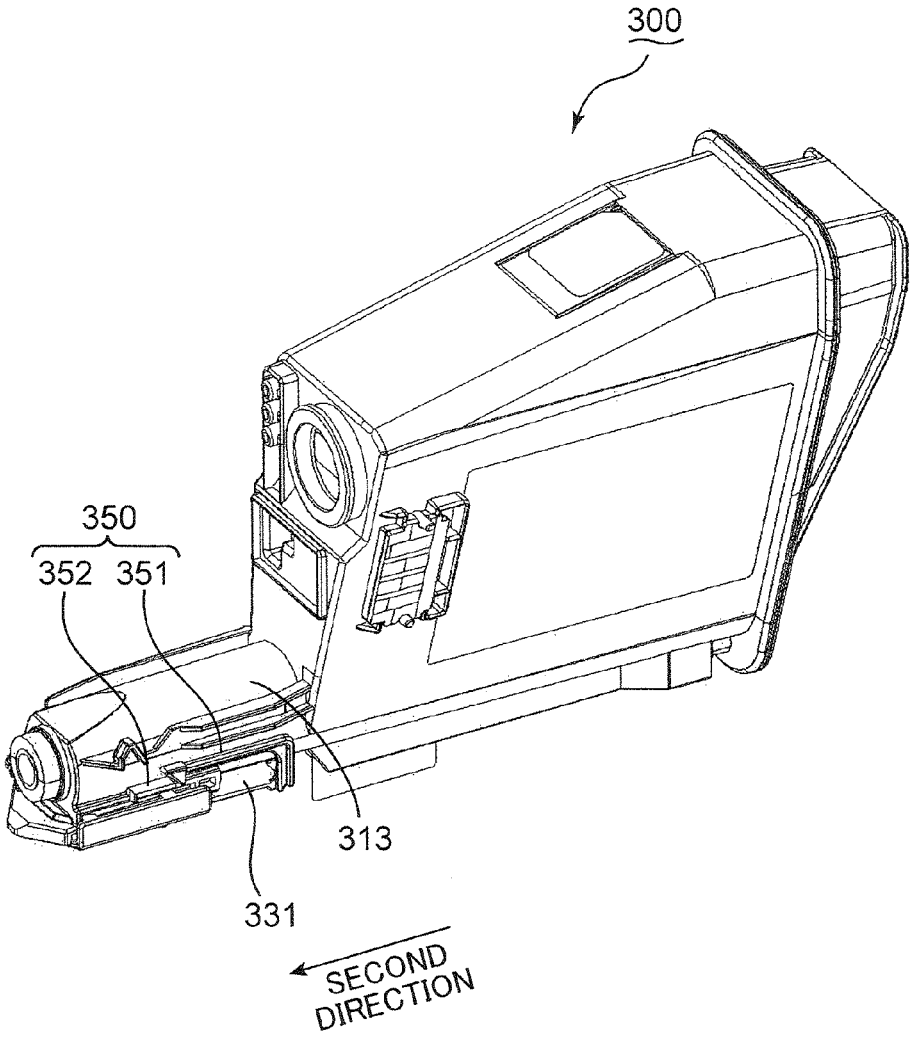
FIG. 19 is a schematic perspective view of the container shown in FIG. 12.

FIG. 19 is a schematic perspective view of the container 300. A lock mechanism 350 for locking displacement of the second shutter piece 331 is described with reference to FIG. 19.

A user may operate the container 300 before the connection process, during the connection process, during the disconnection process, and after the disconnection process. If the user operates the second shutter piece 331 before the connection process is completed, the toner unnecessarily leaks from the container 300. If the user operates the second shutter piece 331 during the disconnection process or after the disconnection process, the toner remaining in the container 300 unnecessarily leaks. The lock mechanism 350 prevents the unintended leakage of the toner.

Figure 20:
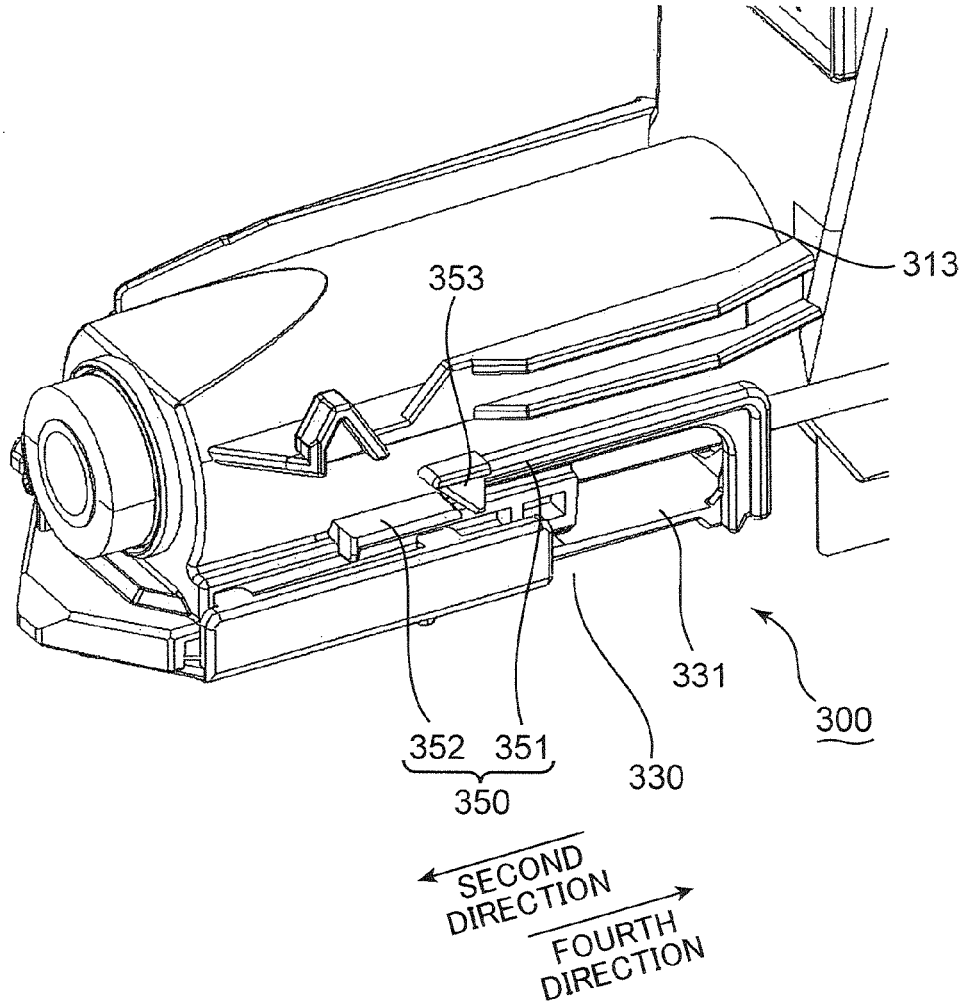
FIG. 20 is a schematic enlarged perspective view of the container shown in FIG. 19.

FIG. 20 is a schematic enlarged perspective view of the container 300 around the lock mechanism 350. The lock mechanism 350 is further described with reference to FIGS. 19 and 20.

The second housing 310 includes a protruding plate 352 which protrudes to the left from the protruding cylinder 313. The protruding plate 352 is a thin plate elongated in the second direction. The second shutter mechanism 330 includes an L-shaped lock arm 351 which protrudes upward from the left corner of the second shutter piece 331 and extends in the second direction. The protruding plate 352 and the lock arm 351 are used as the lock mechanism 350.

Figure 21:
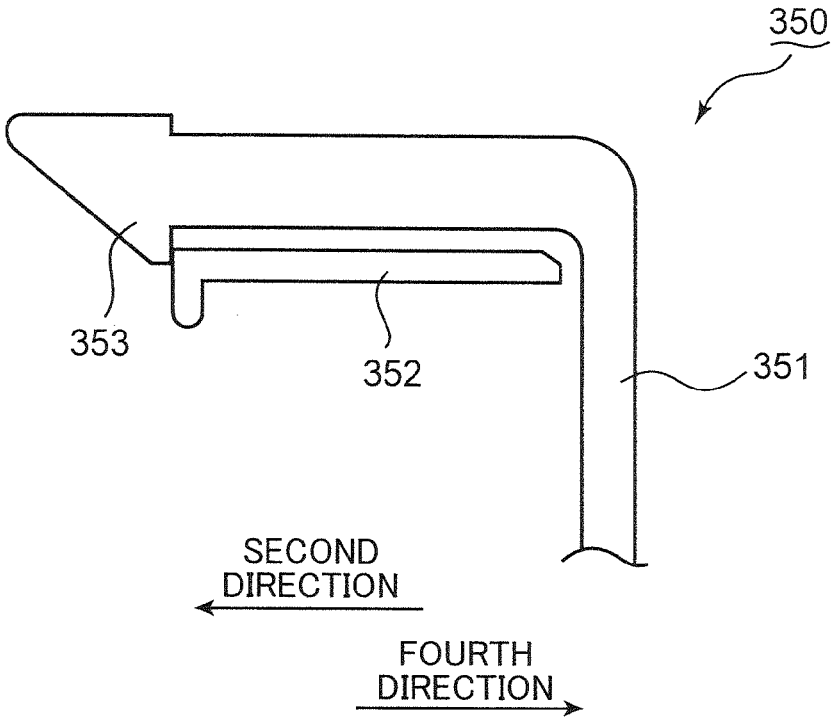
FIG. 21 is a schematic view of a lock mechanism while the second shutter piece shown in FIG. 14 is situated in a second closing position.

FIG. 21 is a schematic view of the lock mechanism 350 while the second shutter piece 331 is situated in the second closing position. The lock mechanism 350 is further described with reference to FIGS. 20 and 21. The second shutter piece 331 shown in FIG. 20 is situated in the second opening position.

As shown in FIG. 20, the lock arm 351 extends from the second shutter piece 331. Therefore, the lock arm 351 is displaced in the second or fourth direction in response to the movement of the second shutter piece 331 in the second or fourth direction.

As shown in FIG. 21, a hook 353 is formed at the distal end of the lock arm 351. The hook 353 protrudes downward to engage with the protruding plate 352 while the second shutter piece 331 is situated in the second closing position. The second shutter piece 331 is appropriately fixed in the second closing position due to the engagement between the hook 353 and the protruding plate 352. While the second shutter piece 331 moves in the second or fourth direction, the hook 353 runs onto the protruding plate 352 which protrudes in an orthogonal direction to the second or fourth direction.

Figure 22:
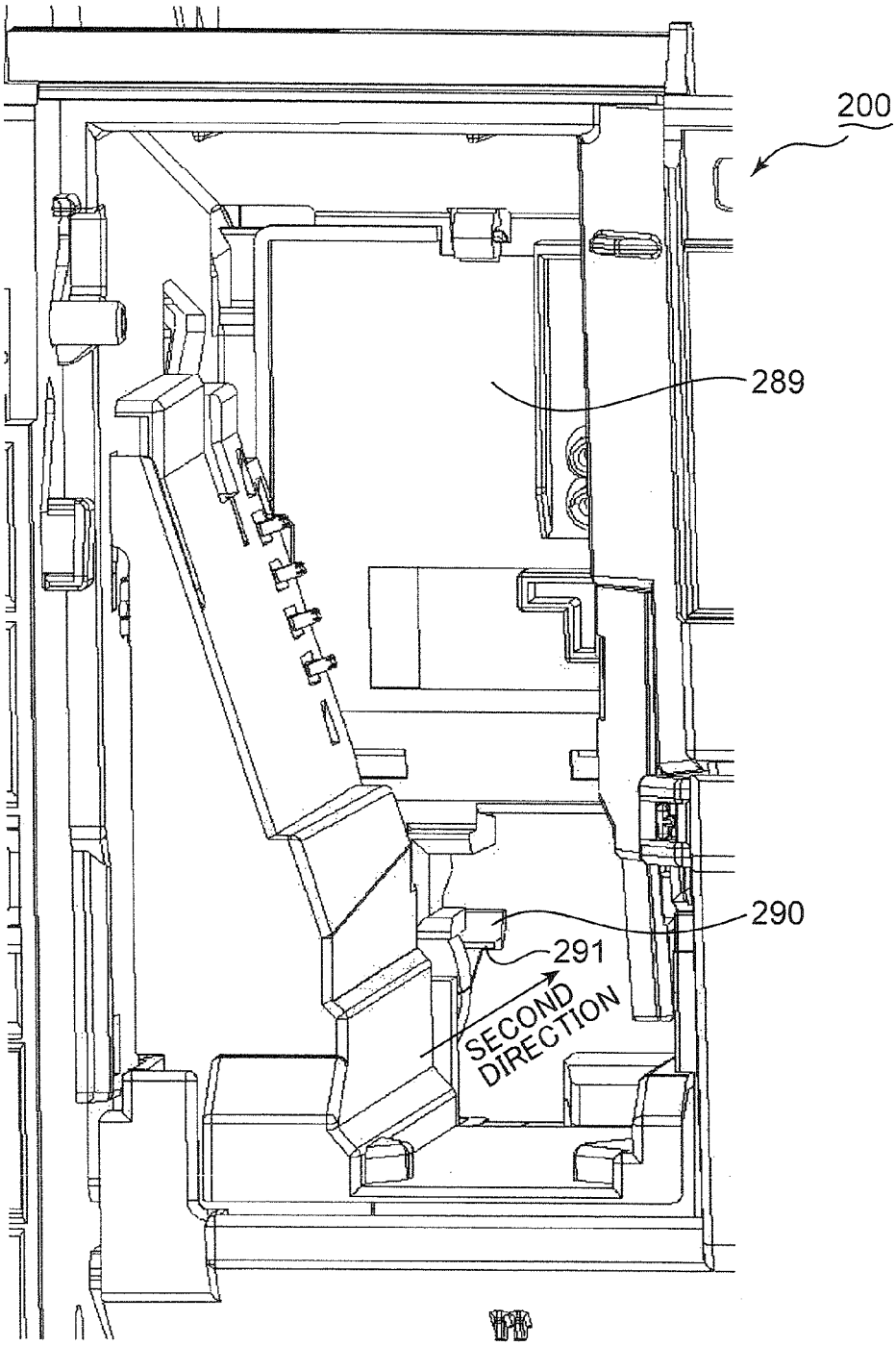
FIG. 22 is a schematic perspective view of a main housing of the printer shown in FIG. 1.

FIG. 22 is a schematic perspective view of the main housing 200 around the insertion path 289. Disengagement between the lock arm 351 and the protruding plate 352 is described with reference to FIGS. 18, 21 and 22.

As shown in FIG. 18, during the disconnection process, the second shutter piece 331 is relatively displaced in the second direction with respect to the second housing 310 as a result of the engagement between the fixed wall 295 and the second protrusion 333. Consequently, when the second shutter piece 331 reaches the second closing position, the lock arm 351 engages with the protruding plate 352 (c.f. FIG. 21).

As shown in FIG. 22, the main housing 200 includes a releasing portion 290 which protrudes in the insertion path 289. The releasing portion 290 is used for disengaging the lock arm 351 from the protruding plate 352 during the connection process.

Figure 23:
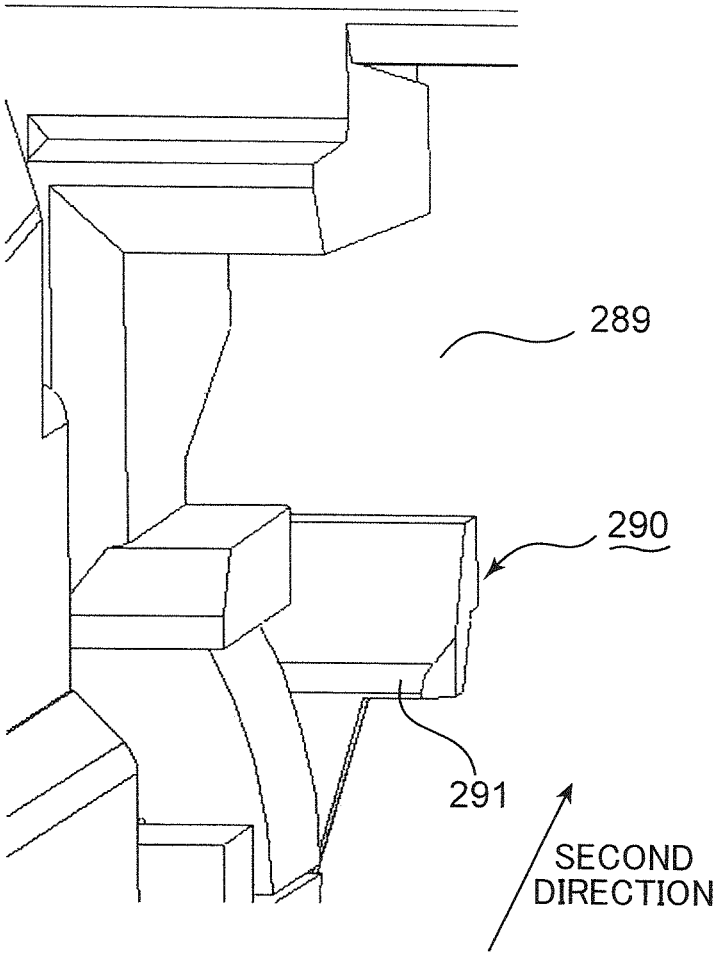
FIG. 23 is a schematic enlarged perspective view of a releasing portion of the main housing shown in FIG. 22.
Figure 24:
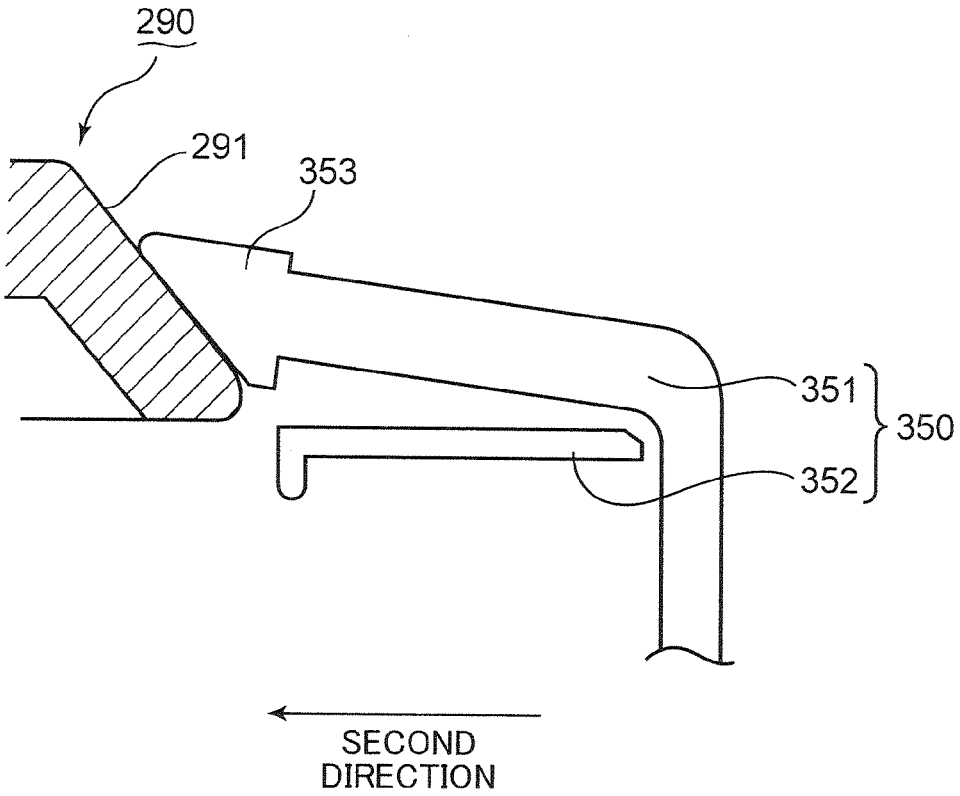
FIG. 24 is a schematic view of a disengaging operation between a lock arm and a protruding plate by the releasing portion shown in FIG. 23.

FIG. 23 is a schematic enlarged perspective view of the releasing portion 290. FIG. 24 is a schematic view of the disengaging operation between the lock arm 351 and the protruding plate 352 by the releasing portion 290. The disengaging operation by the releasing portion 290 is described with reference to FIGS. 13A, 13B, 15B, 20, 23 and 24.

As shown in FIG. 15B, if the container 300 is inserted into the insertion path 289 (i.e. if the container 300 is moved in the second direction), the container 300 approaches the developing device 400. As shown in FIGS. 23 and 24, the releasing portion 290 includes a slope 291 which hits the lock arm 351 of the lock mechanism 350 of the container 300 pushed into the insertion path 289.

As shown in FIG. 24, the substantially triangular hook 353 hits the slope 291. Thereafter, when the container 300 further moves in the second direction, the hook 353 runs onto the slope 291 and is displaced upward. Consequently, the hook 353 and the protruding plate 352 are disengaged. Thereafter, when the container 300 is further displaced in the second direction, as described with reference to FIG. 15B, the first protrusion 332 hits the developing device 400 and starts displacing the second shutter piece 331 from the second closing position to the second opening position. Consequently, as shown in FIGS. 13A and 13B, the second shutter piece 331 is relatively displaced in the fourth direction with respect to the second housing 310. The supply port 319 is exposed over the second shutter piece 331.

(Squeezing Mechanism)

Figure 25A:
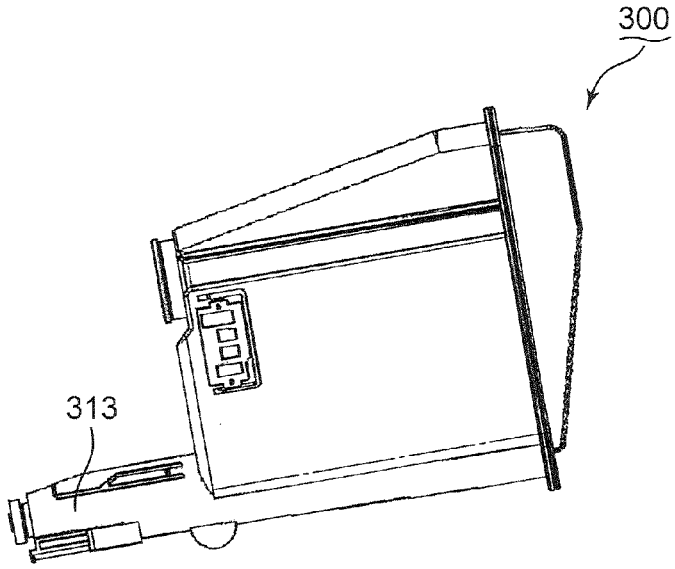
FIG. 25A is a schematic side view of the container in the connection process shown in FIGS. 15A to 15C.
Figure 25B:
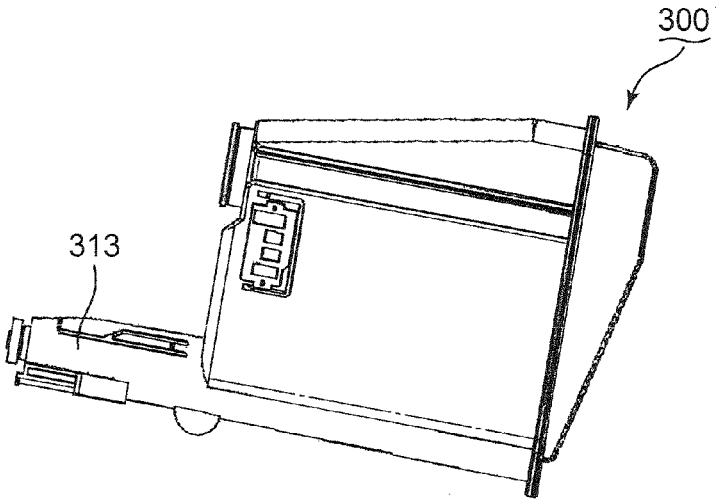
FIG. 25B is a schematic side view of the container in the disconnection process shown in FIG. 18.

FIG. 25A is a schematic side view of the container 300 in the connection process. FIG. 25B is a schematic side view of the container 300 in the disconnection process. The squeezing mechanism is described with reference to FIGS. 3, 5, 25A and 25B.

In the connection process, as shown in FIG. 25A, a user is likely to incline the protruding cylinder 313 downward and push the container 300 into the insertion path 289. In the disconnection process, as shown in FIG. 25B, the user is likely to incline the protruding cylinder 313 upward and pull the container 300 from the insertion path 289.

During the connection or disconnection between the developing device 400 and the container 300, if the developer is filled in the first housing 410 enough for a layer of the developer in the first housing 410 to be substantially flush with the slide surface 413, the inclination of the container 300 shown in FIGS. 25A and 25B results in scattering the developer on the slide surface 413. Thereafter, if the container 300 is slid on the slide surface 413, the developer scattering on the slide surface 413 further scatters in the main housing 200 of the printer 100.

The following squeezing mechanisms in the context of various embodiments are used to prevent the developer from scattering on the slide surface 413.

First Embodiment

A squeezing mechanism according to the first embodiment is described with reference to FIGS. 5 and 10.

As shown in FIG. 10, the first shutter piece 451 includes an upper surface 461 and a lower surface 462 opposite to the upper surface 461. The lower surface 462 faces the slide surface 413 of the first housing 410. The first shutter piece 451 includes a front edge surface 463 facing the guide plate 414 and a rear edge surface 464 opposite to the front edge surface 463.

Figure 26:
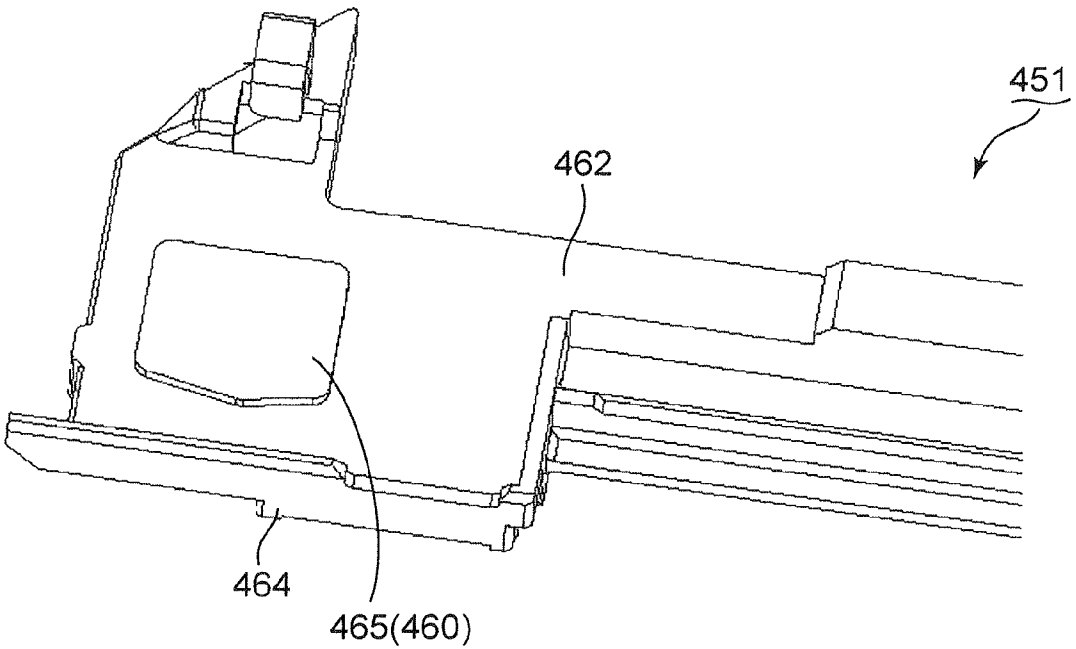
FIG. 26 is a schematic perspective view of the first shutter piece shown in FIG. 10.

FIG. 26 is a schematic perspective view of the first shutter piece 451. The squeezing mechanism 460 is further described with reference to FIGS. 5 and 26. FIG. 26 mainly shows the lower surface 462 of the first shutter piece 451.

The squeezing mechanism 460 includes a substantially rectangular swelled portion 465 which protrudes from the lower surface of the slide plate 452. The swelled portion 465 is complementary to the feed port 411. While the first shutter piece 451 is situated in the first closing position, the swelled portion 465 is inserted in the feed port 411. Consequently, the developer is pushed into the first housing 410 by the swelled portion 465. In this embodiment, the swelled portion 465 is exemplified as the protrusion.

Figure 27:
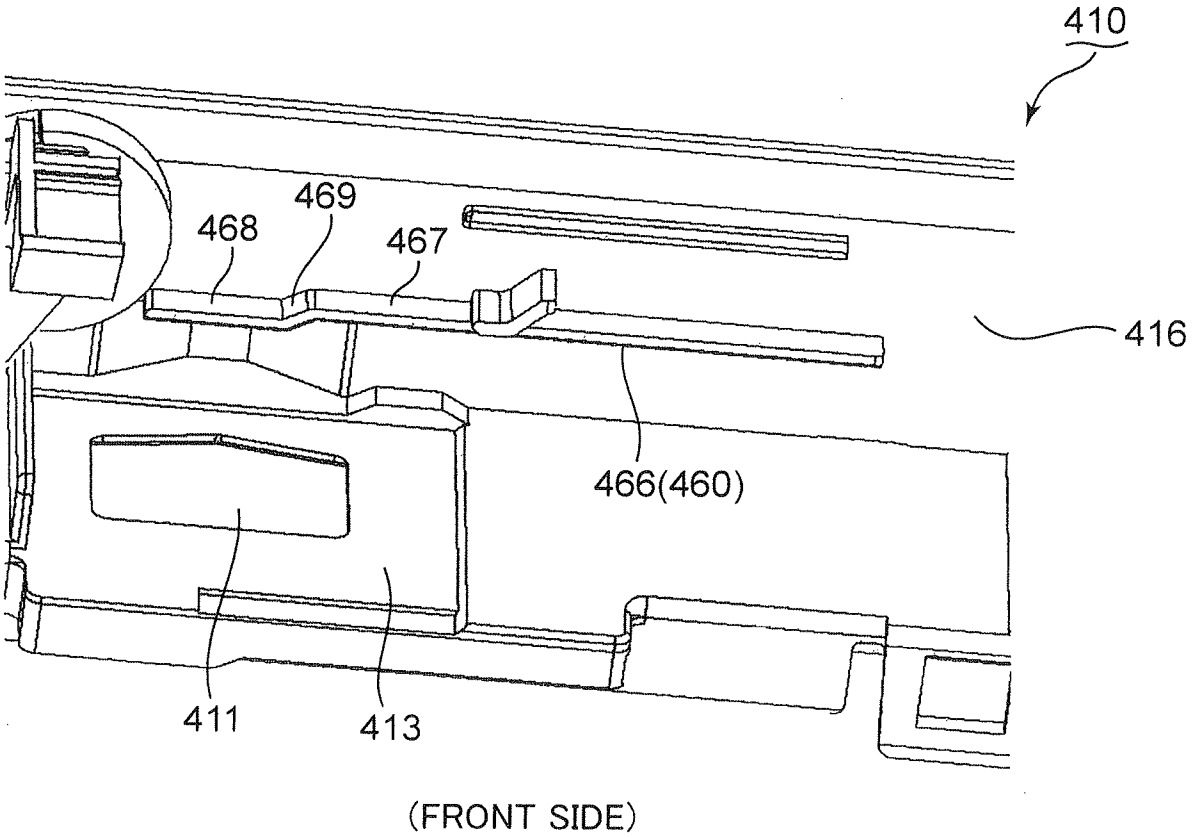
FIG. 27 is a schematic enlarged perspective view of a first housing of the developing device shown in FIG. 5.
Figure 28:
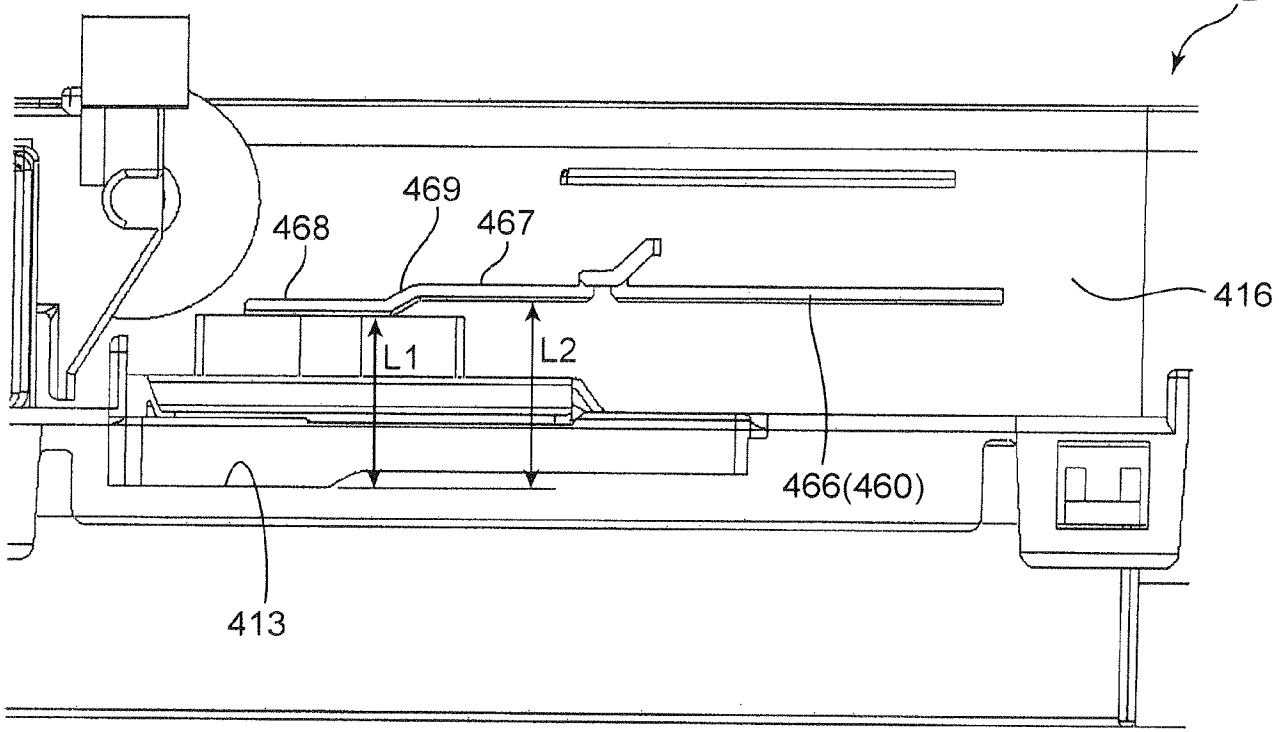
FIG. 28 is a schematic front enlarged view of the first housing shown in FIG. 27.

FIG. 27 is a schematic enlarged perspective view of the first housing 410. FIG. 28 is a schematic front enlarged view of the first housing 410. The squeezing mechanism 460 is further described with reference to FIGS. 26 to 28.

The first housing 410 includes an upright wall 416 standing from the slide surface 413. The upright wall 416 faces the rear edge surface 464 of the first shutter piece 451.

The squeezing mechanism 460 further includes a rail portion 466 which projects forward from the upright wall 416. The rail portion 466 and the slide surface 413 vertically hold the rear edge surface 464 of the first shutter piece 451. Accordingly, the first shutter piece 451 less likely to move away from the slide surface 413. Therefore, the first shutter piece 451 may be smoothly displaced between the first closing and opening positions. In this embodiment, the rail portion 466 is exemplified as the limiting piece.

The rail portion 466 includes a first rail 467, which guides movement of the first shutter piece 451 from the first opening position to the first closing position, a second rail 468, which protrudes above the feed port 411, and a transition rail 469 inclined so as to assist in transfer of the first shutter piece 451 between the first and second rails 467, 468.

As shown in FIG. 28, a distance L1 between the second rail 468 and the slide surface 413 is shorter than a distance L2 between the first rail 467 and the slide surface 413. Therefore, when the first shutter piece 451 reaches the first closing position, the first shutter piece 451 is pressed against the slide surface 413 by the second rail 468. Consequently, the swelled portion 465 is pushed into the feed port 411. In this embodiment, the first rail 467 is exemplified as the first piece. The second rail 468 is exemplified as the second piece.

Second Embodiment

Figure 29A:
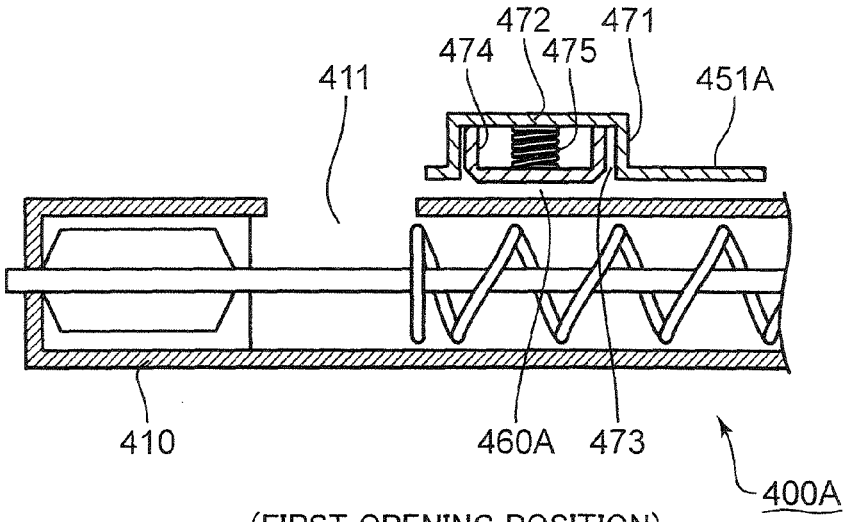
FIG. 29A is a schematic view of a developing device mounted with a squeezing mechanism according to the second embodiment.
Figure 29B:
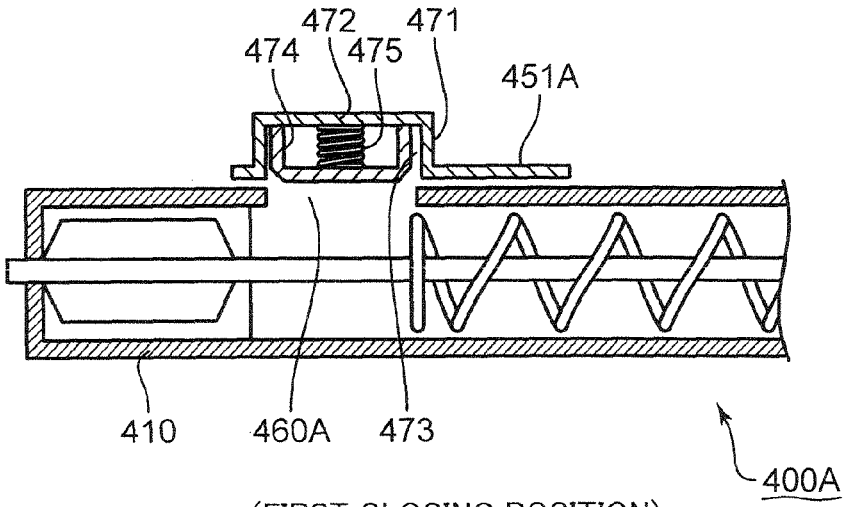
FIG. 29B is a schematic view of the developing device on which the squeezing mechanism is mounted according to the second embodiment.

FIGS. 29A and 29B are schematic views of a developing device 400A mounted with a squeezing mechanism 460A according to the second embodiment. The squeezing mechanism 460A according to the second embodiment is described with reference to FIGS. 29A and 29B. The developing device 400A has the same structure as the developing device 400 except the squeezing mechanism 460A. Therefore, the same components as the components described in the context of the first embodiment are denoted by the same reference numerals. The developing device 400A may be incorporated in the printer 100 instead of the developing device 400.

The developing device 400A includes a first shutter piece 451A, which moves between the first opening and closing positions, instead of the first shutter piece 451 described in the context of the first embodiment. The first shutter piece 451A shown in FIG. 29A is situated in the first opening position. The first shutter piece 451A shown in FIG. 29B is situated in the first closing position. The squeezing mechanism 460A is mounted on the first shutter piece 451A.

Figure 30:
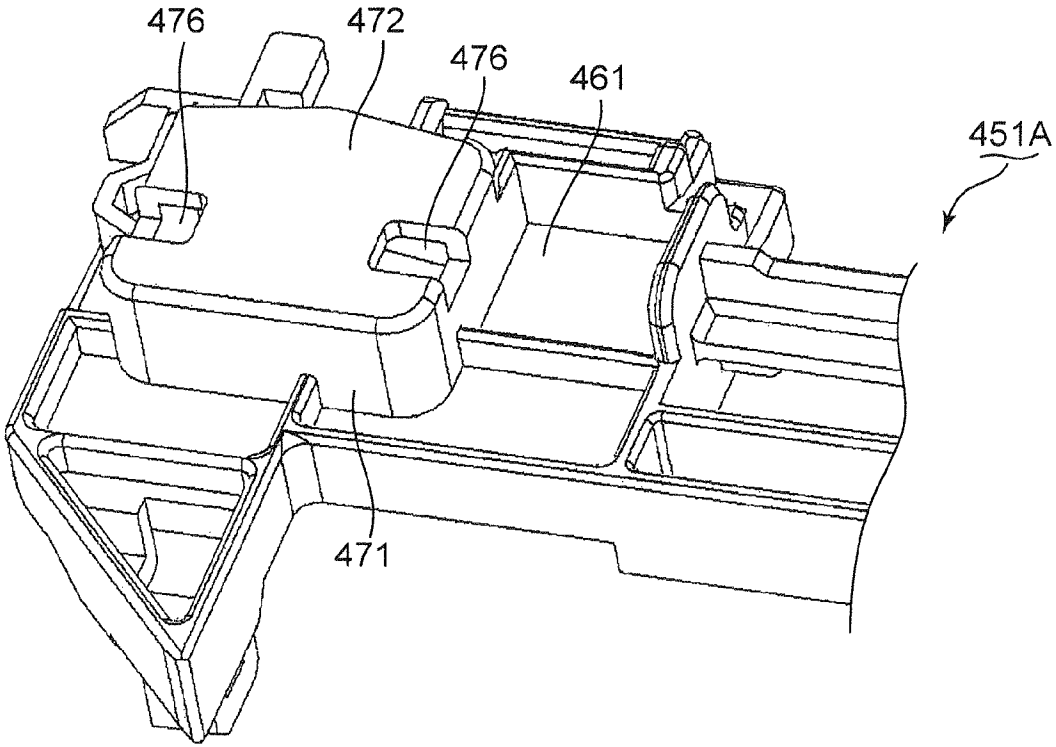
FIG. 30 is a schematic perspective view of a first shutter piece of the developing device shown in FIGS. 29A and 29B.
Figure 31:
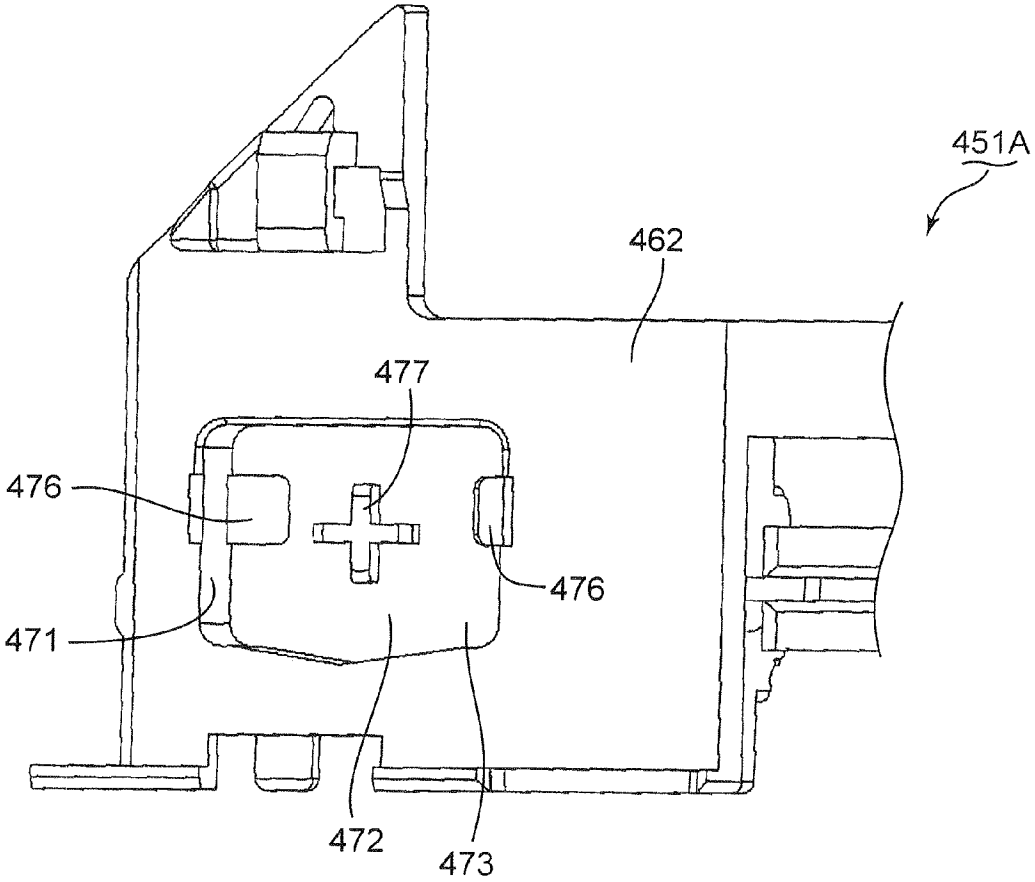
FIG. 31 is a schematic perspective view of the first shutter piece of the developing device shown in FIGS. 29A and 29B.

FIGS. 30 and 31 are schematic perspective views of the first shutter piece 451A. The first shutter piece 451A is described with reference to FIGS. 29A to 31. FIG. 30 mainly shows the upper surface 461 of the first shutter piece 451A. FIG. 31 mainly shows the lower surface 462 of the first shutter piece 451A.

The first shutter piece 451A includes a substantially rectangular peripheral wall 471, which protrudes upward from the slide plate 452, and a top wall 472, which closes a region surrounded by the upper edge of the peripheral wall 471. As shown in FIG. 29A, while the first shutter piece 451A is situated in the first opening position, the squeezing mechanism 460A is housed in a housing space 473 surrounded by the first housing 410, the peripheral wall 471 and the top wall 472. In this embodiment, the housing space 473 is exemplified as the cavity.

As shown in FIGS. 29A and 29B, the squeezing mechanism 460A includes a squeezing piece 474 projected from and retracted in the housing space 473, and a coil spring 475 which elastically connects the top wall 472 with the squeezing piece 474. While the first shutter piece 451A is situated in the first opening position, the coil spring 475 is compressed so that the squeezing piece 474 is retracted in the housing space 473. When the first shutter piece 451A reaches the first closing position, the squeezing piece 474 biased by the coil spring 475 is pushed out from the housing space 473 to protrude into the first housing 410 through the feed port 411. In this embodiment, the squeezing piece 474 is exemplified as the projection. The coil spring 475 is exemplified as the biasing member.

Figure 32:
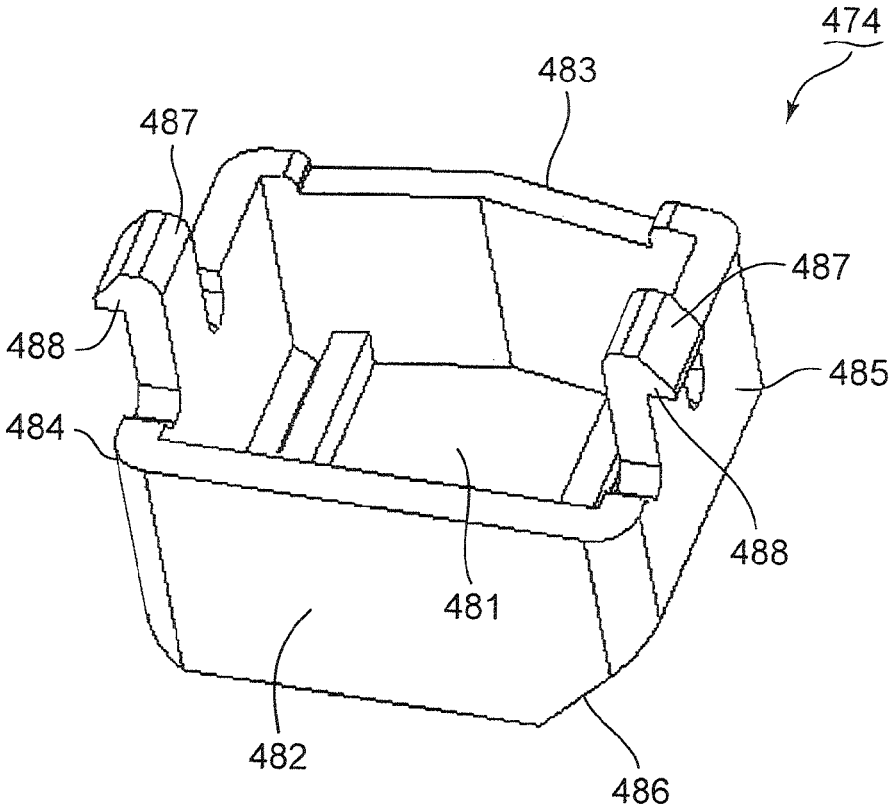
FIG. 32 is a schematic perspective view of a squeezing piece of the squeezing mechanism shown in FIGS. 29A and 29B.

FIG. 32 is a schematic perspective view of the squeezing piece 474. The squeezing piece 474 is described with reference to FIGS. 29A to 32.

As shown in FIG. 32, the squeezing piece 474 includes a substantially rectangular bottom wall 481; a front wall 482, which stands upright from the bottom wall 481; a rear wall 483, which is opposite to the front wall 482; a left wall 484, which is adjacent to the front wall 482, the rear wall 483, and the bottom wall 481; and a right wall 485 opposite to the left wall 484. The squeezing piece 474 further includes an inclined wall 486 formed between the bottom and right walls 481, 485. The inclined wall 486 makes it smooth that the squeezing piece 474 projects from and retracts in the housing space 473 during displacement of the first shutter piece 451A between the first opening closing positions.

The squeezing piece 474 further includes a pair of engaging arms 487, each of which protrudes upward from the upper edge of the left or right wall 484, 485. The engaging arms 487 include hooks 488 which protrude outward.

A pair of openings 476 respectively corresponding to the paired engaging arms 487 are formed in the top wall 472. The hooks 488 formed at the distal ends of the engaging arms 487 are inserted into the openings 476 to engage with the upper edge of the peripheral wall 471.

As shown in FIG. 31, the first shutter piece 451A includes a fixture projection 477 in a substantially cross shape which projects from the lower surface of the top wall 472. The upper end of the coil spring 475 is fixed to the fixture projection 477. The lower end of the coil spring 475 is pressed against the bottom wall 481 of the squeezing piece 474.

When the first shutter piece 451A reaches the first closing position, the coil spring 475 expands to displace the squeezing piece 474 downward. Meanwhile, the hooks 488 engage with the peripheral wall 471. The squeezing piece 474 is appropriately held by the first shutter piece 451A.

(Protrusion Amount)

Figure 33:
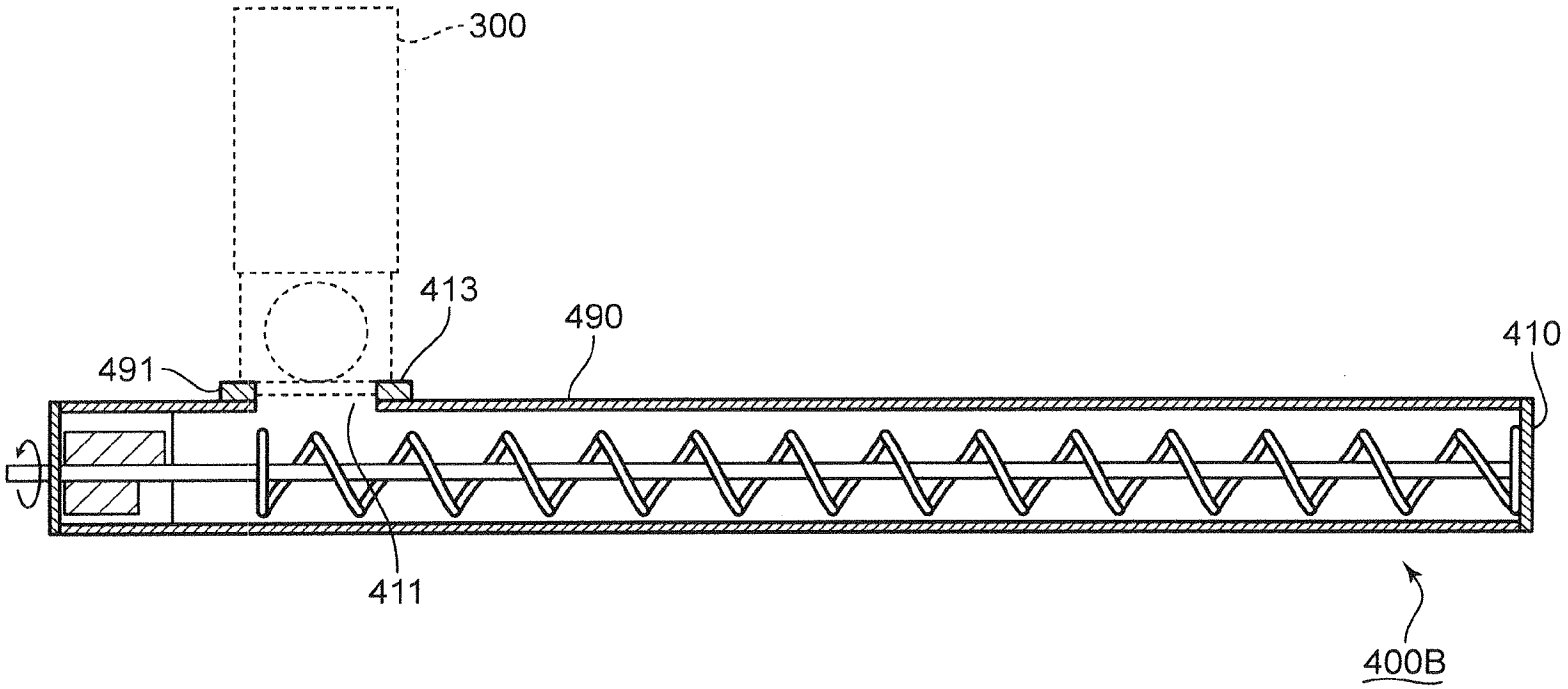
FIG. 33 is a schematic view of the developing device connected to the container shown in FIG. 11.

FIG. 33 is a schematic view of a developing device 400B connected to the container 300. The developing device 400B may be the developing device 400 or 400A described in the context of the first or second embodiment. Therefore, the same components as the components described in the context of the first and/or second embodiments are denoted by the same reference numerals. A connecting structure between the container 300 and the developing device 400B is described with reference to FIG. 33.

The first housing 410 of the developing device 400B includes a housing wall 490 provided with the feed port 411, and a seal member 491 attached to the housing wall 490. The seal member 491 forms the feed port 411 in cooperation with the first housing 410. Therefore, the seal member 491 may be formed in a substantially rectangular ring shape. The seal member 491 forms the slide surface 413.

The container 300 is set on the seal member 491. The seal member 491 has cushioning characteristics to create a seal structure between the housing wall 490 and the container 300. Accordingly, the developer is less likely to leak between the container 300 and the developing device 400B.

Figure 34:
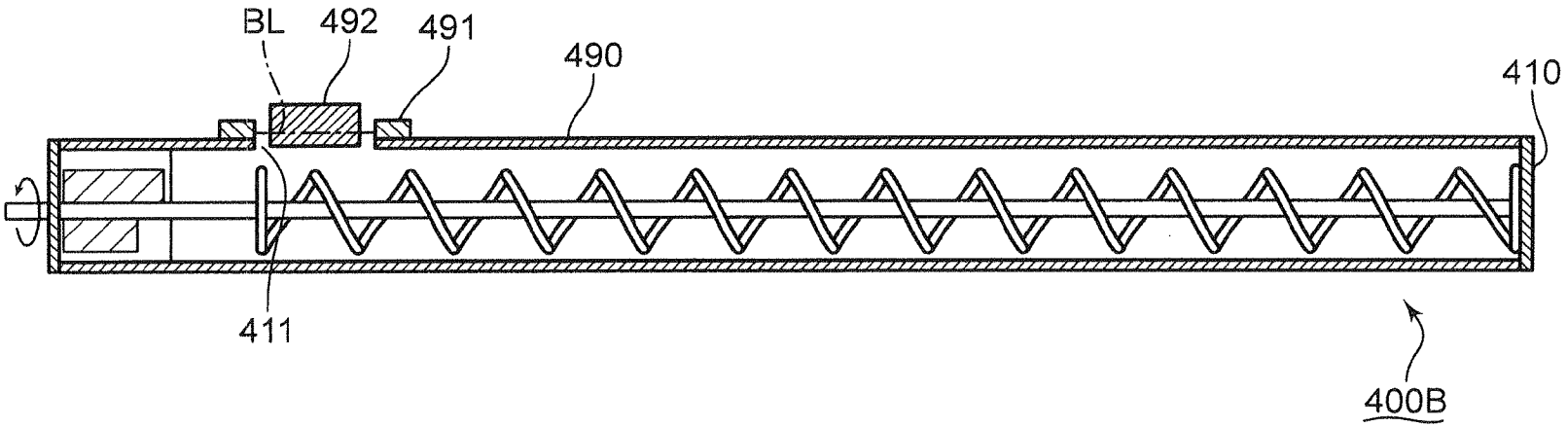
FIG. 34 is a schematic view of the developing device shown in FIG. 33.

FIG. 34 is a schematic view of the developing device 400B. A protrusion amount of a protrusion 492 penetrating in the feed port 411 is described with reference to FIG. 34. The protrusion 492 may be the swelled portion 465 or the squeezing piece 474 described in the context of the first or second embodiment.

In FIG. 34, a boundary line BL between the seal member 491 and the housing wall 490 is indicated by a chain line. It is preferable that the protrusion 492 penetrates into the feed port 411 beyond the boundary line BL. Accordingly, there is little leakage of the developer from the developing device 400B even under compressive deformation of the seal member 491.

The developing devices according to the various embodiments described above are appropriately connected to the container. When the developing devices are connected to the container, the developer is less likely to be scraped out from the feed port. Therefore, the image forming apparatus is less likely to be contaminated by the developer.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A developing device for developing an electrostatic latent image with developer supplied from a container, the developing device comprising:

a housing including a connection surface to which the container connects, the connection surface being provided with a feed port for feeding the developer; and a shutter mechanism configured to selectively open and close the feed port, wherein the shutter mechanism includes a shutter piece that moves between a closing position for closing the feed port and an opening position for opening the feed port, and a squeezing mechanism that protrudes from the shutter piece situated in the closing position to squeeze the developer into the housing through the feed port, the squeezing mechanism includes a protrusion configured to protrude from the shutter piece, and a limiting piece fixed on the housing and configured to limit separation of the shutter piece from the connection surface, the limiting piece includes a first piece configured to guide movement of the shutter piece from the opening position to the closing position, and a second piece connected to the first piece and being distant from the connection surface by a shorter distance than a distance between the first piece and the connection surface, and the shutter piece moving along the first piece and the second piece and when the shutter piece is situated in the closing position, the second piece presses the shutter piece against the connection surface to push the protrusion into the feed port.

2. The developing device according to claim 1, wherein the limiting piece includes a transition rail configured to assist in transfer of the shutter piece between the first piece and the second piece.

3. The developing device according to claim 1, wherein the protrusion projects from and retracts in a cavity formed in the shutter piece, and the squeezing mechanism further includes a biasing member that biases the protrusion to push out the protrusion from the cavity, and when the shutter piece is situated in the closed position, the protrusion biased by the biasing member is pushed into the feed port.

4. The developing device according to claim 2, wherein the housing includes a housing wall provided with the feed port, and a seal member, which is attached to the housing wall so as to form the connection surface, and the protrusion penetrates into the feed port formed in the housing wall beyond the seal member.

5. An image forming apparatus for forming an image with developer, comprising:

a container configured to store the developer; and the developing device according to claim 1.

* * * * *